US012550999B2

(12) United States Patent
Henderson

(10) Patent No.: US 12,550,999 B2
(45) Date of Patent: Feb. 17, 2026

(54) TACTICAL MANAGEMENT BACKPACK

(71) Applicant: MAH Group, Inc, Huntington Beach, CA (US)

(72) Inventor: Michael A. Henderson, Huntington Beach, CA (US)

( * ) Notice: Subject to any disclaimer, the term of this patent is extended or adjusted under 35 U.S.C. 154(b) by 170 days.

(21) Appl. No.: 18/467,551

(22) Filed: Sep. 14, 2023

(65) Prior Publication Data

US 2024/0008626 A1 Jan. 11, 2024

Related U.S. Application Data

(63) Continuation-in-part of application No. 17/810,690, filed on Jul. 5, 2022, now abandoned.

(51) Int. Cl.
*A45F 3/04* (2006.01)
*A45C 13/02* (2006.01)
(Continued)

(52) U.S. Cl.
CPC ..... *A45F 3/04* (2013.01); *A45C 13/02* (2013.01); *A45C 13/103* (2013.01);
(Continued)

(58) Field of Classification Search
CPC ..... A45C 11/20; A45C 13/02; A45C 13/103; A45C 13/1046; A45C 2013/1015; A45C 2200/20; A45C 3/001; A45C 3/10; A45C 5/06; A45C 5/065; A45F 2003/003; A45F 2200/05; A45F 2200/0583; A45F 3/04; A45F 3/06; A45F 3/46; A45F 2003/001
(Continued)

(56) References Cited

U.S. PATENT DOCUMENTS 2,792,980 A 5/1957 Brown
5,090,526 A 2/1992 Jacober
(Continued)

FOREIGN PATENT DOCUMENTS

CN 202233694 U * 5/2012

OTHER PUBLICATIONS

CN-202233694-U Translation, CAO, May 30, 2012 (Year: 2015).*
Wolfpak.Official, Social Media Post, Jun. 4, 2022.

*Primary Examiner* — Nathan J Newhouse
*Assistant Examiner* — Matthew T Theis
(74) *Attorney, Agent, or Firm* — CIONCA IP Law P.C.

(57) ABSTRACT

A tactical management backpack having: a backpack body; an insulated pocket nested within the backpack body, the insulated pocket having; an insulated cavity and an insulative layer surrounding the insulated cavity, wherein the insulative layer is configured to slow heat transfer between the insulated cavity and an external environment; an engagement surface attached to the insulative layer; and a securing band configured to selectively engage with the engagement surface, such that the securing band is configured to secure an object within the insulated pocket; and a side pocket associated with the backpack body, the side pocket being configured to selectively secure a receptacle. Thus an advantage is the insulated pocket may be used to store food products while maintaining their desired temperature for longer. Another advantage is that the side pockets may be used to carry drinks, such that foods and drinks may be securely stored within the backpack.

15 Claims, 16 Drawing Sheets

(51) Int. Cl.

| | |
|---|---|
| ***A45C 13/10*** | (2006.01) |
| *A45C 3/00* | (2006.01) |
| *A45C 11/20* | (2006.01) |

(52) U.S. Cl.
CPC ..... *A45C 13/1046* (2013.01); *A45C 3/001* (2013.01); *A45C 11/20* (2013.01); *A45C 2013/1015* (2013.01); *A45C 2200/20* (2013.01)

(58) Field of Classification Search
USPC ..... 224/153
See application file for complete search history.

(56) References Cited

U.S. PATENT DOCUMENTS

| | | | | |
|---|---|---|---|---|
| 6,435,390 | B1 | 8/2002 | Abramowicz | |
| 8,844,756 | B2 * | 9/2014 | Beyburg | A45F 3/46 220/592.2 |
| 2009/0184143 | A1 | 7/2009 | Witt | |
| 2010/0254634 | A1 * | 10/2010 | Liu | A45C 13/30 383/72 |
| 2022/0257000 | A1 * | 8/2022 | Bartlett | A61B 50/30 |

* cited by examiner

TACTICAL MANAGEMENT BACKPACK

CROSS-REFERENCE TO RELATED APPLICATIONS

This application is a continuation-in-part and claims the benefit of U.S. Non-Provisional application Ser. No. 17/810,690, filed on Jul. 5, 2022, which is hereby incorporated by reference, to the extent that they are not conflicting with the present application.

BACKGROUND OF INVENTION

1. Field of the Invention

The invention relates generally to portable storage receptacles and specifically to backpacks configured to store and preserve foods and/or other materials while simultaneously holding drinks.

2. Description of the Related Art

Cases designed for portable food storage may provide a variety of features that allow for foods (or other materials) to be transported while simultaneously maintaining their temperature, thus preserving them. For example, cases such as coolers and cooler bags may provide a portable receptacle capable of preserving a food product at a suitable storage temperature for longer than a conventional receptacle. However, currently utilized food preservation receptacles lack the necessary structures to suitably preserve food at the necessary temperature while keeping said food securely in place during travel.

The shifting of unsecured food containers within a food storage receptacle may lead to spillage, undesired agitation and/or damage to the food item. Existing receptacles may not be capable of simultaneously holding drinks securely alongside the stored food or allowing for said receptacle to be carried easily while keeping the user's hands free. Additionally, it may not be possible to carry non-food items safely within the same container as food items, as the temperature conditions, humidity, etc., required for or caused by food storage may negatively influence other objects, such as electronics, stored within container. Furthermore, many food storage receptacles come in bulky, cumbersome sizes that do not adapt to the size of the food containers stored within.

Therefore, there is a need to solve the problems described above by providing a device and method for securely storing food and other materials while preserving the food within a compact, portable receptacle.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a tactical management backpack is provided, the tactical management backpack comprising: a backpack body; an insulated pocket nested within the backpack body, the insulated pocket having; an insulative layer surrounding an insulated cavity, the insulative layer having: a top wall; a bottom wall; a left wall; a right wall; an inner wall; and an outer wall; wherein the inner wall is attached to the top wall, bottom wall, left wall and right wall, and the outer wall is pivotally attached to the bottom wall and configured to selectively engage with the top wall, left wall and right wall to seal the insulated cavity, wherein the insulative layer is configured to slow heat transfer between the insulated cavity and an external environment; at least one engagement surface attached to the insulative layer; a securing band configured to selectively engage with the engagement surface at a selected height, such that the securing band is configured to secure an object within the insulated pocket; a pair of lower side belts, each lower side belt comprising: a front segment attached to the insulated pocket; a back segment attached to a back side of the backpack body; and a joining buckle configured to selectively secure the front segment to the corresponding back segment; a first side pocket associated with a left lateral side of the backpack body and a second side pocket associated with a right lateral side of the backpack body, wherein the first and second side pockets are each configured to selectively engage with a corresponding receptacle to secure the corresponding receptacle to the backpack body. Thus, an advantage is food or other materials may be stored within the insulated pocket and maintained at a higher or lower temperature for longer than would be possible with a standard container. Another advantage is that containers may be held securely within the insulated pocket though the utilization of a securing band to restrict container movement. Another advantage is that the positioning of the securing band may be adjusted to allow it to secure containers of varying sizes and quantities within the insulated pocket. Another advantage is that the provided insulated pocket and the side pocket allow for food and drink to be stored within the disclosed tactical management backpack simultaneously, while maintaining the temperature of said food independently of the side pocket. Another advantage is that additional pockets may be provided to allow for the storage of other items without keeping them within the insulated pocket. Another advantage is that the insulated pocket may be configured to selectively protrude within the backpack body, thus allowing the insulated pocket to suitably conform to the size of the held food storage container, while not contributing significantly to the overall bulk of the tactical management backpack.

In another aspect, a tactical management backpack is provided, the tactical management backpack comprising: a backpack body; an insulated pocket nested within the backpack body, the insulated pocket having: an insulative layer surrounding an insulated cavity, wherein the insulative layer is configured to selectively seal the insulated cavity and slow heat transfer between the insulated cavity and an external environment; a first and second vertically oriented loop fastener strips attached to the insulative layer; and a securing band having two engaging ends and a securing band body portion disposed between and associated with the two engaging ends, each engaging end having hook fasteners, wherein the engaging ends of the securing band are configured to engage with the first vertically oriented loop fastener strip and the second vertically oriented loop fastener strip at a selected height corresponding to a height of an object to be secured within the insulated pocket, such that the securing band is horizontally oriented. Again, an advantage is food or other materials may be stored within the insulated pocket and maintained at a higher or lower temperature for longer than would be possible with a standard container. Another advantage is that containers may be held securely within the insulated pocket though the utilization of a securing band to restrict container movement. Another advantage is that the positioning of the securing band may be adjusted to allow it to secure containers of varying sizes and quantities within the insulated pocket. Another advantage is that provided insulated pocket and the side pocket allow for food and drink to be stored within the disclosed tactical management backpack simultaneously, while maintaining the temperature of said food. Another advantage is that additional pockets may be provided to allow for the storage of other items without keeping them within the insulated pocket. Another advantage is that the insulated pocket may be configured to selectively protrude within the backpack body, thus allowing the insulated pocket to suitably conform to the size of the held food storage container, while not contributing significantly to the overall bulk of the tactical management backpack.

In another aspect, a tactical management backpack is provided, the tactical management backpack comprising: an insulated pocket having: an insulative layer surrounding an insulated cavity, the insulative layer having: a top wall; a bottom wall; a left wall; a right wall; an inner wall; and an outer wall; wherein the inner wall is attached to the top wall, bottom wall, left wall and right wall, and the outer wall is attached to the bottom wall and configured to selectively engage with the top wall, left wall and right wall to seal the insulated cavity, wherein the insulative layer is configured to slow heat transfer between the insulated cavity and an external environment; a first loop fastener strip attached to the left wall; a second loop fastener strip attached to the right wall; and a securing band having two engaging ends and a securing band body portion disposed between and associated with the two engaging ends, each engaging end having hook fasteners, wherein the engaging ends of the securing band are configured to engage with the first loop fastener strip and the second loop fastener strip at a selected height corresponding to a height of an object to be secured within the insulated pocket, such that the securing band is disposed between the first loop fastener strip and the second loop fastener strip. Again, an advantage is food or other materials may be stored within the insulated pocket and maintained at a higher or lower temperature for longer than would be possible with a standard container. Another advantage is that containers may be held securely within the insulated pocket though the utilization of a securing band to restrict container movement. Another advantage is that the positioning of the securing band may be adjusted to allow it to secure containers of varying sizes and quantities within the insulated pocket. Another advantage is that provided insulated pocket and the side pocket allow for food and drink to be stored within the disclosed tactical management backpack simultaneously, while maintaining the temperature of said food. Another advantage is that additional pockets may be provided to allow for the storage of other items without keeping them within the insulated pocket. Another advantage is that the insulated pocket may be configured to selectively protrude within the backpack body, thus allowing the insulated pocket to suitably conform to the size of the held food storage container, while not contributing significantly to the overall bulk of the tactical management backpack.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
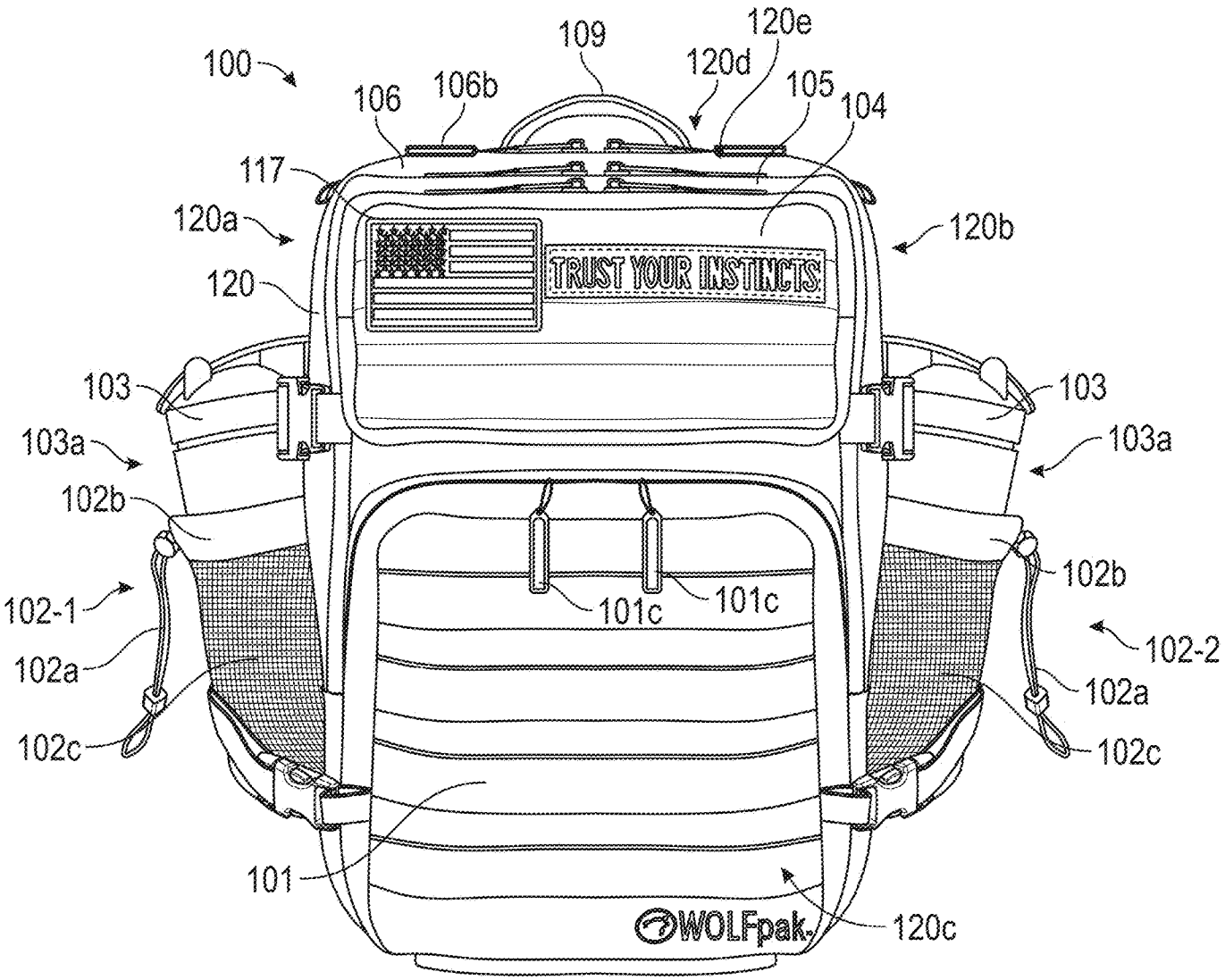
FIG. 1 illustrates the front view of the disclosed tactical meal management backpack in the closed state, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 101 and 201, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates the front view of the disclosed tactical management backpack 100 in the closed state, according to an aspect. The disclosed tactical management backpack ("tactical meal management backpack", "meal management backpack", "backpack") 100 may utilize a plurality of different pockets, sleeves, receptacles, etc. in order to facilitate secure positioning and suitable storage conditions for each food, drink or other item it secures. The tactical management backpack 100 itself may be comprised of a backpack body 120 having a plurality of pockets nested within it, and a plurality of straps, external pockets and receptacles, etc. attached to it. For example, a handling strap 109 may be secured to a top side 120*e* of the backpack body 120 to allow for easy movement of the tactical meal management backpack 100 without utilizing the backpack straps, such as backpack straps 610 of FIG. 6.

In order to securely hold a receptacle 103, such as a drink receptacle, while maintaining the receptacle 103 in an upright position, the meal management backpack 100 may have at least one side pocket ("drink pocket") 102-1, 102-2. Each side pocket 102-1, 102-2 may be configured to carry any suitably sized receptacle 103 or container, each of which may be used to carry drinks or materials. In an embodiment, each side pocket 102-1, 102-2 may be referred to as a drink pocket, while each held receptacle 103 may be referred to as a drink receptacle. Each side pocket 102-1, 102-2 may have a tension cord housing 102*b* attached to backpack body 120 and a tension cord 102*a* nested within or otherwise associated with a tension cord housing 102*b*, such that the tension cord 102*a* may be tightened/constricted around a receptacle 103 while said receptacle 103 is held within a side pocket 102-1, 102-2 to secure the receptacle 103 to the meal management backpack 100, as can be seen in FIG. 1. In an embodiment, a side pocket 102-1, 102-2 may be positioned on each lateral side 120*a*, 120*b* of the backpack body 120, such that superior balance may be achieved while carrying two comparable receptacles 103, while still allowing said receptacles 103 to be rapidly accessed by a user wearing (or otherwise in close proximity to) the meal management backpack 100. In said embodiment, a first side pocket 102-1 may be disposed on or otherwise associated with a left lateral side 120*a* of the backpack body 120, while a second side pocket 102-2 may be disposed on or otherwise associated with a right lateral side 120*b* of the backpack body 120. Each side pocket 102-1, 102-2 may be associated with the backpack body 120 such that the receptacles 103 may remain upright as long as the backpack 100 remains upright.

The side pockets 102-1, 102-2 may be comprised of several components, including a receptacle slot 102*c* configured to surround and seat the receptacle 103, a tension cord housing 102*b* associated with and disposed above the receptacle slot 102*c*, wherein the tension cord housing is configured to surround an upper portion 103*a* of the receptacle 103, and a tension cord 102*a* partially housed or nested within the tension cord housing 102*b*. In order to secure a receptacle 103 within the side pocket 102-1, 102-2, the receptacle 103 may be inserted into the receptacle slot 102*c*. Next, the tension cord 102*a* housed within the tension cord housing 102*b* may be adjusted to constrict the tension cord housing 102*b* around the upper portion 103*a* of the receptacle 103. The receptacle slot 102*c* may be used to surround the majority (or a sufficiently large portion) of the receptacle 103, such that when the upper portion 103*a* of the receptacle 103 is constricted by the tension cord 102*a* within the tension cord housing 102*b*, that the receptacle 103 may remain securely within the side pocket 102-1, 102-2 until the tension cord 102*a* is loosened.

The receptacle slot 102*c* may be made of a mesh material such that the amount of drink remaining in a held receptacle 103 may remain visible through the open mesh portions of the receptable slot while stored within the side pocket 102-1, 102-2. Utilizing a mesh material for the receptacle slot 102*c* may also help minimize the weight of the backpack 100 while still allowing the receptacle slot to securely hold a receptacle 103. In an alternative embodiment, the receptacle slot 102*c* may be made of a solid material, such as the receptacle slot of alternative side pocket 1502 of FIGS. 15A-15B. The tension cord housing 102*b* may be made out a material comparable to that of the backpack body 120, such as canvas or another suitably lightweight, flexible and durable material that may be configured to be constricted around the receptacle 103 by the internally nested tension cord 102*a*. The tension cord 102*a* may be made of a rigid or suitably elastic material, such that the tension cord 102*a* may be tightened within the tension cord housing 102*b* to constrict said tension cord housing 102*b* around the corresponding receptacle 103 to keep said receptacle 103 in place.

An insulated pocket 101 may be nested within the front side 120*c* of the backpack body 120. In an embodiment, this insulated pocket 101 may be selectively opened and closed through the manipulation of an insulated pocket zipper 101*c* secured to or otherwise associated with the insulated pocket 101. This insulated pocket 101 may be comprised of an insulative layer ("insulative liner", "layer", "liner"), such as EPE ("expanded polyethylene") insulative layer 701*a* of FIG. 7, surrounding a cavity, such as insulated cavity 719 of FIG. 7. Through the utilization of the insulative layer, the disclosed insulated pocket 101 may be configured to maintain the temperature of a food/drink product or other material stored within the insulated pocket 101 for an extended period of time, as will be described in greater detail hereinbelow. The size of the insulated pocket 101, and thus the volume of insulated pocket 101, may be optimized, such that the pocket is large enough to hold the required volume of items, without making the backpack overly bulky. The insulated cavity, such as insulated cavity 719 of FIG. 7 will be described in greater detail hereinbelow.

Figure 3:
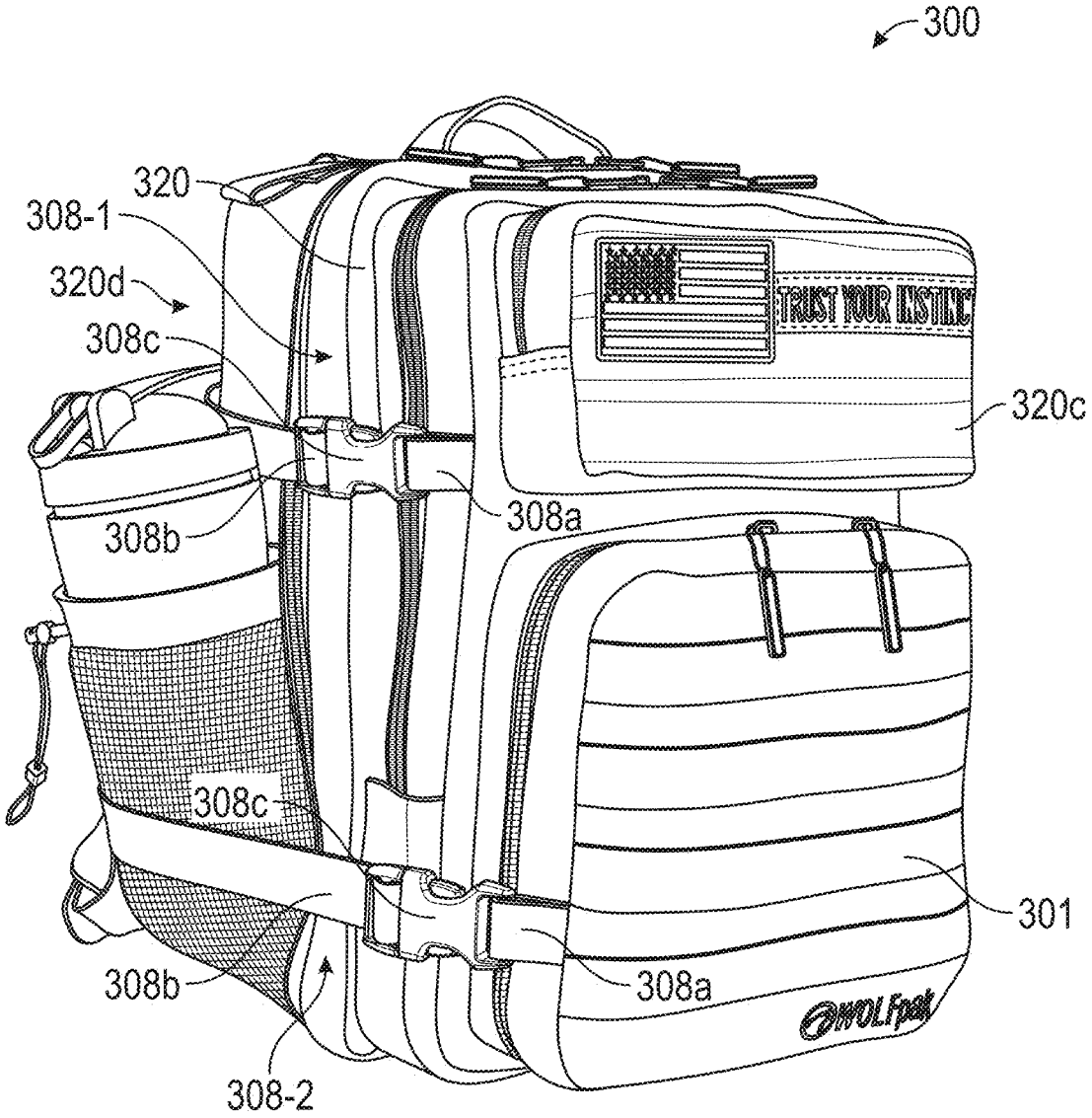
FIG. 3 illustrates the side perspective view of the disclosed tactical meal management backpack in the closed state, according to an aspect.

A front pocket 104 may also be nested within the front side 120*c* of the backpack body and disposed above the insulated pocket 101. This front pocket 104, and any other pockets disclosed hereinbelow, may not utilize any specialty insulation or insulative layers, but may still be utilized to store food, drinks and other materials that do not require stringent temperature moderation. The height of the insulated pocket 101 and the height of the front pocket 104 combined may be roughly the same as the height of the center pocket 105 or the height of the back pocket 106. As such, the backpack body 100 may form a shape roughly consistent with that of a rectangular prism, as seen in FIG. 3. In an embodiment, a front pocket zipper, such as front pocket zipper 1304*a* of FIG. 13, may be configured to selectively open and close the front pocket 104. It should be understood that each pocket described herein, may have a corresponding zipper configured to be used to selectively open and close said pocket to secure held items within the corresponding pocket and prevent loss/droppage of items. For example, a back pocket 106 may be selectively opened through the utilization of a back pocket zipper 106*b* attached to the backpack body 120.

A center pocket 105 may be nested within the backpack body 120 between the front pocket 104 and the back pocket 106. As will be described in greater detail hereinbelow, the insulative layer of the insulated pocket 101 may be configured to selectively protrude into the space defined by the center pocket 105, in order to provide the room needed to properly store items within the insulated pocket 101.

The back pocket 106 may be nested within the backpack body 120 on a back side 120*d* of the backpack body 120. This back pocket 106 may be comparable in size (e.g. volume, height) to the center pocket 105, but may not have a portion of the insulated pocket 101 protruding into it. This back pocket 106 may include additional internal pockets or sleeves, such as back pocket sleeve 1006*a* of FIG. 10, nested within the back pocket 106, to hold additional items securely and prevent held items from shifting around within the back pocket 106. The various pockets of the meal management backpack 100 will be described in greater detail hereinbelow. It should be understood that the disclosed backpack 100 may not be limited to only handling food/drinks and may hold any materials suitable for transport by backpack. Said materials may also be stored within the insulated pocket 101 if moderation of their temperature is necessary or desirable. In an alternative embodiment, the back pocket 106, center pocket 105, and/or front pocket 104 may be provided with corresponding insulative layers, as described hereinabove for the insulated pocket 101, such that said pockets may also provide temperature maintenance for any items stored within them.

Each pocket, including the insulated pocket 101, front pocket 104, center pocket 105 and back pocket 106 may have a corresponding cavity surrounded by a suitable enclosing structure. For example, as discussed hereinabove, the insulated pocket 101 may have a cavity, such as insulated cavity 719 of FIG. 7, surrounded by an enclosing structure, such as the insulative layer 701*a* of FIG. 7. The enclosing structure of each pocket may be configured to be selectively opened to expose the corresponding cavity to the external environment, such as external environment 716 of FIG. 7. In an embodiment, each enclosing structure may be selectively opened through manipulation of a corresponding zipper, or another suitable selective engagement device. In said embodiment, the front pocket 104 may be configured to be selectively opened to expose a front cavity (not shown) to the external environment through selective manipulation of a front pocket zipper, such as front pocket zipper 1304*a* of FIG. 13. Equivalent zipper structures may be configured to allow for selective opening of each pocket 101, 104, 105, 106 of the backpack 100, thus opening their corresponding cavities to the external environment.

The disclosed meal management backpack 100 may also be provided with a variety of decorative elements. As can be seen in FIG. 1, a decorative patch 117 may be attached to or otherwise associated with the backpack body 120, for example, on an external surface of the front pocket 104, in order to properly display said decorative patch 117 during use. The decorative patch 117 may be made from a material that is durable, but also flexible, such as plastic, rubber, or a durable fabric, such as canvas. The decorative patch 117 may be attached to the backpack body through the utilization of a suitable engagement mechanism including, but not limited to, adhesives or sewing, depending on the materials used for the decorative patch 117 and the backpack body 120. The backpack body 120 may be provided with an aesthetically driven design, such as vibrant colors, to achieve a desired design aesthetic, and/or a functionally driven design, such as camouflage, to achieve certain functional capabilities (e.g., being camouflaged in a certain environment, and thus harder to see).

Figure 2:
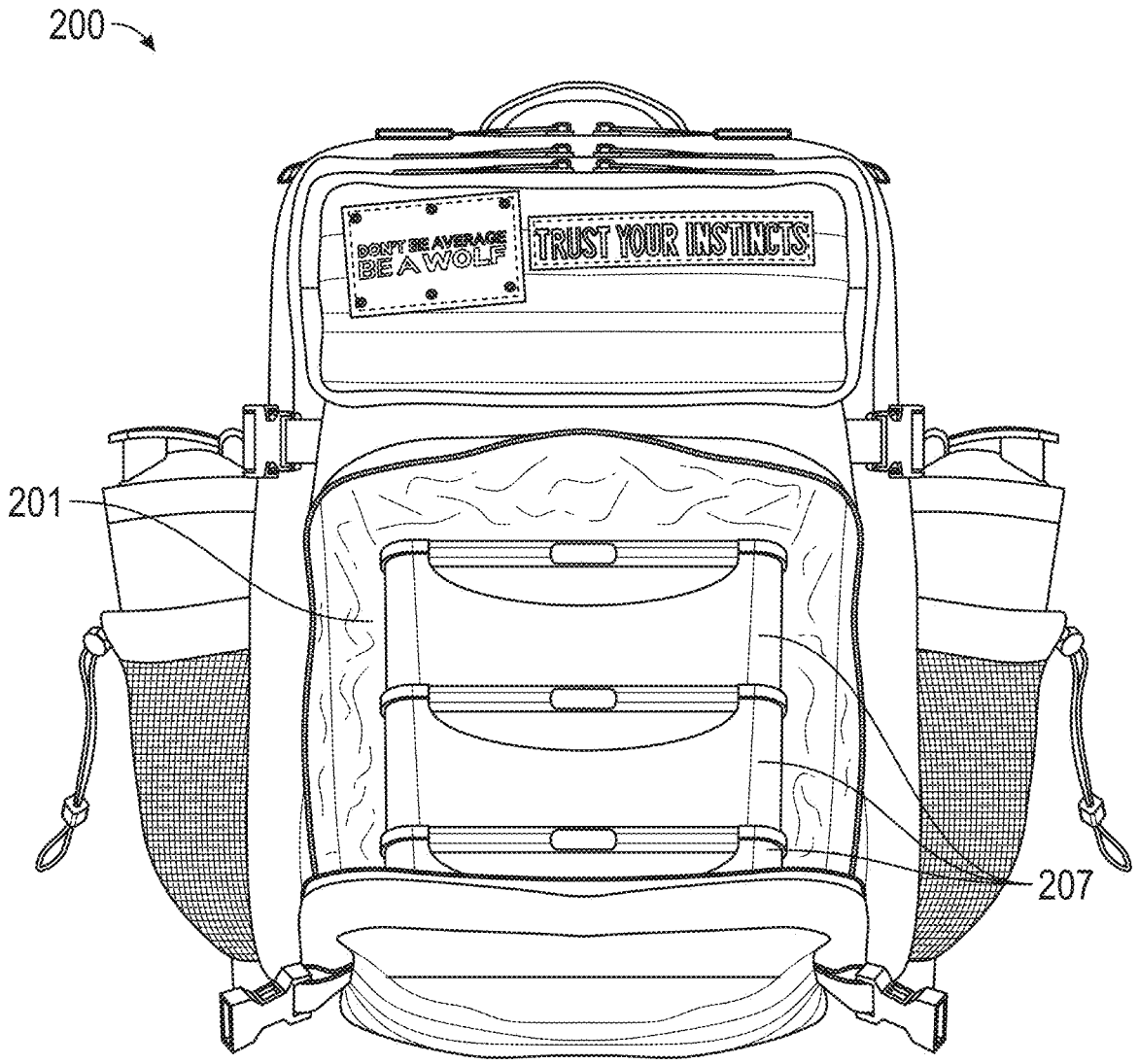
FIG. 2 illustrates the front view of the disclosed tactical meal management backpack having an insulated pocket in the open state, according to an aspect.

FIG. 2 illustrates the front view of the disclosed tactical meal management backpack 200 having an insulated pocket 201 in the open state, according to an aspect. As described hereinabove, the insulated pocket 201 may be configured to hold items, such as containers 207, within an insulated cavity surrounded by an insulative layer, such that when closed, the insulated pocket 201 may help to maintain the temperature of the containers and their contents for long durations of time. In FIG. 2, the insulated pocket may be seen holding three containers 207. Each container 207 may be used to hold food, drink, or other items that may require temperature moderation and a secured positioning/orientation. As will be described in FIGS. 7-9, the insulated pocket 201 may have several features and aspects that allow it to securely hold containers in place, to prevent them from shifting around in the insulated pocket 201 during travel.

FIG. 3 illustrates the side perspective view of the disclosed tactical meal management backpack 300 in the closed state, according to an aspect. In order to ensure that the tactical meal management backpack 300 remains together and secure during usage, the front side 320*c* and back side 320*d* of the backpack body 320 may be secured to each other by side belts 308-1, 308-2. As seen in FIG. 3, these side belts may include an upper side belt 308-1 and a lower side belt 308-2 that work in conjunction with the zippers of each pocket to keep the backpack body 320 closed and together while traveling. Each side belt 308-1, 308-2 may be comprised of a back segment 308*b* attached to the back side 320*d* of the backpack body 320, a front segment 308*a* attached to the front side 320*c* of the backpack body 320, and a joining buckle 308*c* configured to selectively adjoin the corresponding front segment 308*a* and back segment 308*b*. In an embodiment, the structure of the backpack 320 may be symmetrical, such that an upper side belt 308-1 and a lower side belt 308-2 may travel around each corresponding lateral side of the backpack body 320 (e.g., the left lateral side and right lateral side), such that each backpack has a pair of upper side belts 308-1 and a pair of lower side belts 308-2. In an embodiment, the back segment 308*b* of each lower side belt 308-2 may be attached to the back side of the backpack body 320*d* and the front segment 308*a* of each lower side belt 308-2 may be attached to the insulated pocket 301, such that upon engagement of the front segments 308*a* with the corresponding back segments 308*b* of the lower side belts 308-2 using their corresponding joining buckles 308*c*, the pockets, including the insulated pocket 301 may be constricted to further ensure that they remain closed when necessary. As such, these lower side belts 308-2 (as well as the upper side belts 308-1) may help the zippers in keeping the pockets sealed, thus preventing the loss of any held items.

Figure 4:
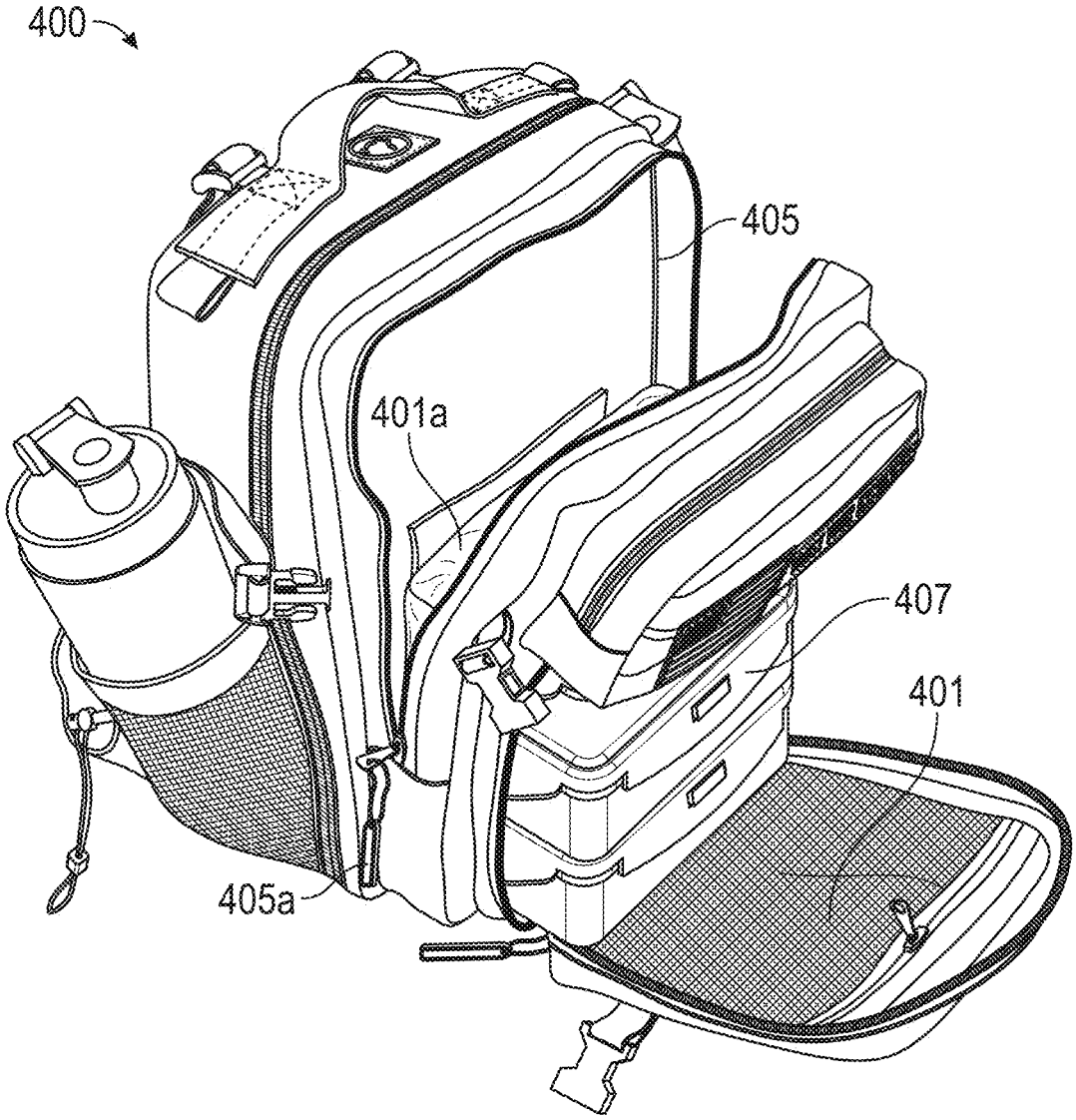
FIG. 4 illustrates the top perspective view of the disclosed tactical meal management backpack having the insulated pocket and the center pocket in the open state, according to an aspect.

FIG. 4 illustrates the top perspective view of the disclosed tactical meal management backpack 400 having an insulated pocket 401 and a center pocket 405 in the open state, according to an aspect. From the embodiment of FIG. 4, it can be seen that the containers 407 stored within the insulated pocket 401 may cause a wall of the insulated pocket (e.g., a portion of the aforementioned enclosing structure of the insulated pocket) to protrude into the space normally provided within the center pocket 405. This feature allows for larger containers 407 to be more easily stored within the insulated pocket 401, while allowing said container 407 to remain sealed within the insulative layer, without significantly increasing the bulk of the backpack 400. It should be understood that this feature of an expandable insulated pocket 401 may not be necessary to utilize in all instances and may only be fully utilized when the storage of larger or greater quantities/volumes of containers in the insulated pocket 401 results in the expansion of the insulated pocket 401 into the volume of the center pocket. The insulative layer 401*a* of the insulated pocket 401 may act as the dividing wall between the inside of the insulated pocket 401 and the inside of the center pocket 405. As described previously, the center pocket 405 may be selectively sealed through the selective manipulation of the attached center pocket zipper 405*a*.

Figure 5:
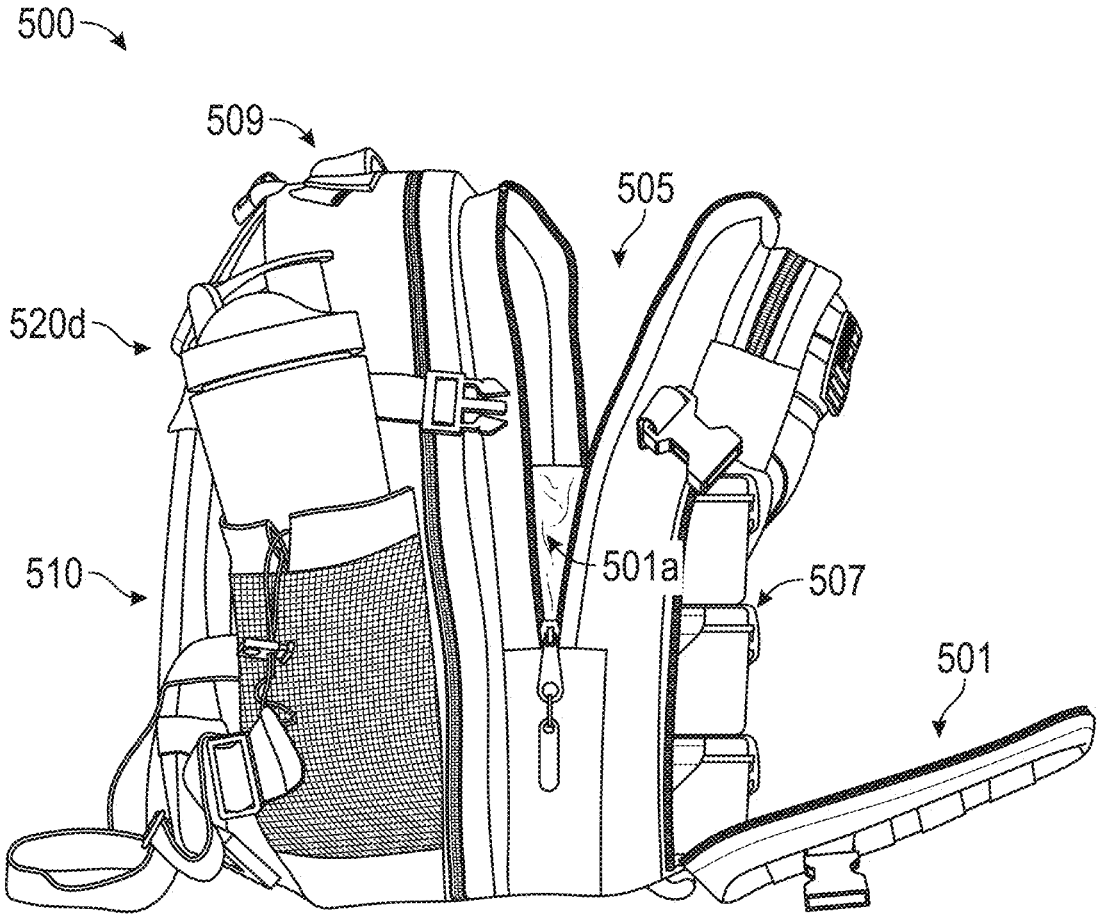
FIG. 5 illustrates the left side view of the disclosed tactical meal management backpack having the insulated pocket and the center pocket in the open state, according to an aspect.

FIG. 5 illustrates the side view of the disclosed tactical meal management backpack 500 having the insulated pocket 501 and the center pocket 504 in the open state, according to an aspect. In an embodiment, the protrusion of the containers 507 stored within the insulated pocket 501 into the volume normally occupied by the center pocket 505 may also be seen from the side perspective, wherein the insulative layer 501*a* may be seen protruding into the center pocket 505. Additionally, backpack straps 510 attached to the back side 520*d* of the backpack body may also be seen, which may provide additional handling means to supplement or replace the prior disclosed handling strap 509

Figure 6:
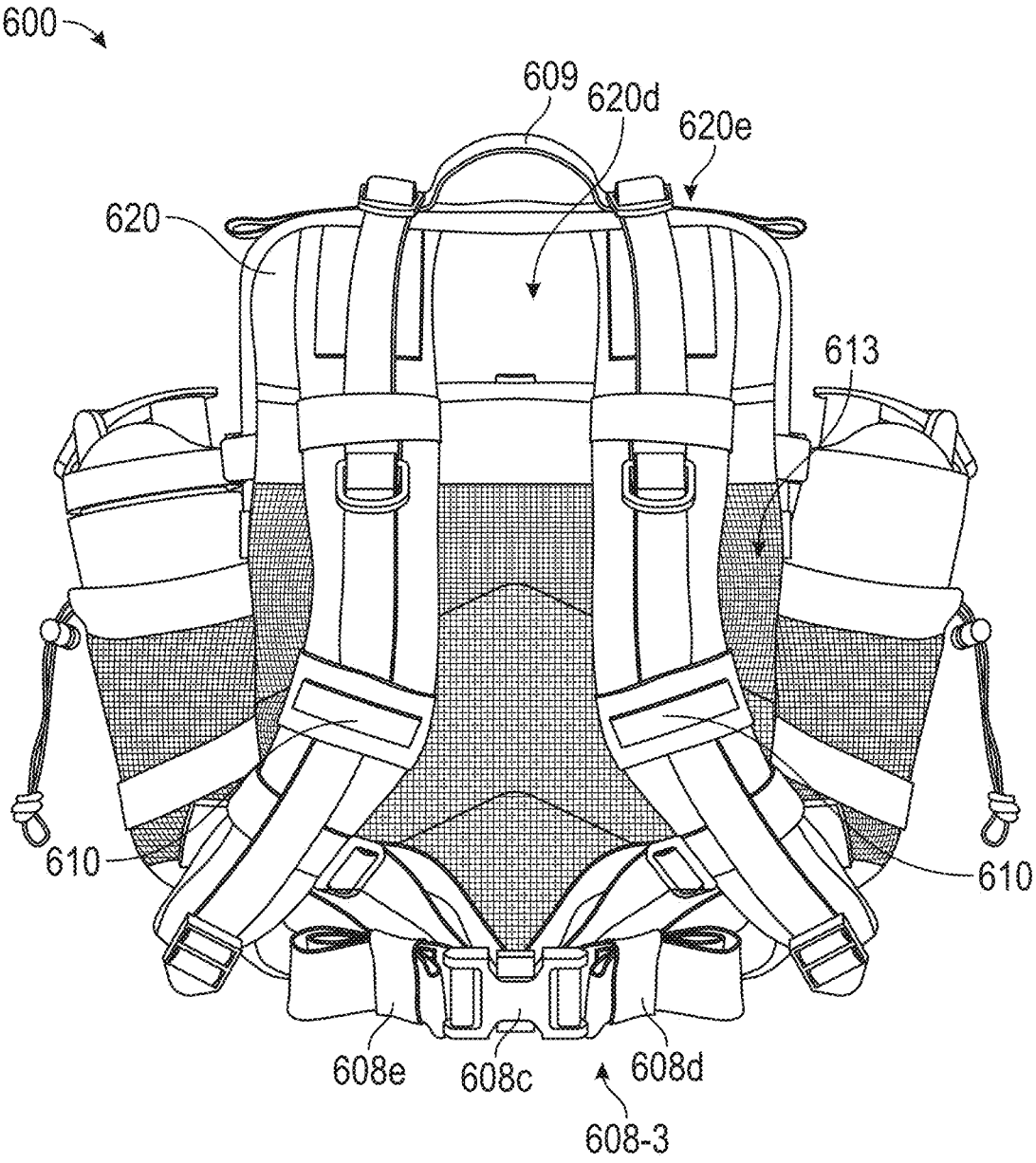
FIG. 6 illustrates the back view of the disclosed tactical meal management backpack, according to an aspect.

FIG. 6 illustrates the back view of the disclosed tactical meal management backpack 600, according to an aspect. As disclosed hereinabove, the meal management backpack 600 may have two different types of handling devices, depending on the application of said backpack 600. The handling strap 609 may be attached to or otherwise associated with a top side 620*e* of the backpack body 620, such that the backpack 600 may be handled easily with one hand engaged with the handling strap 609 and accessed readily by the individual holding the backpack 600. The backpack straps 610 may be attached to the back side 620*d* of the backpack body 620 and may allow a user to wear the backpack 600 on their back for long term storage while keeping their hands free. A user may wear the backpack 600 by inserting each of their arms between a corresponding backpack strap 610 and the backpack body 620, thus engaging with the backpack straps 610 in a manner comparable to conventional backpacks.

A third belt in the form of a back belt 608-3 may be attached to the backpack body 620, such that a user may utilize the joining buckle 608*c* of the back belt 608-3 to selectively secure the backpack 600 to themself. In an embodiment, the back belt 608-3 may be comprised of a left segment 608*d* configured to engage with a left side securing clamp, such as securing clamp 1425 of FIG. 14A, wherein said left side securing clamp is directly attached to the backpack body 620, a right segment 608*e* configured to engage with a right side securing clamp (not shown), wherein said right side securing clamp is directly attached to the backpack body 620, and a joining buckle 608*c* configured to selectively adjoin the left segment 608*d* with the right segment 608*e*. In an embodiment, a first buckle portion of the joining buckle 608*c* attached to the left segment 608*d* may be configured to selectively engage with a second buckle portion attached to the right segment 608*e* to adjoin the first and second belt segments together, effectively wrapping the back belt 608-3 around the back side 620*d* of the backpack body 620, and thus the waist of a user wearing the meal management backpack 600.

A user may utilize this back belt 608-3 to ensure that the meal management backpack 600 remains secured to themself during travel. The back belt 608-3 may have a similar structure and be comprised of similar elements and materials to the prior disclosed side belts 308-1, 308-2 of FIG. 3. The joining buckles 608*c* of the disclosed belts may be made of durable materials, such as metals or plastics, whereas the belt segments 608*a*, 608*b*, 608*d*, 608*e* may be made of suitable sturdy but flexible materials, such as canvas or stronger fabrics. Additionally, as seen in FIG. 6, one or more cushioning pads 613 may be attached to the back side 620*d* of the backpack body 620 in order to ensure the backpack 600 rests comfortably on the user's back while worn.

Figure 7:
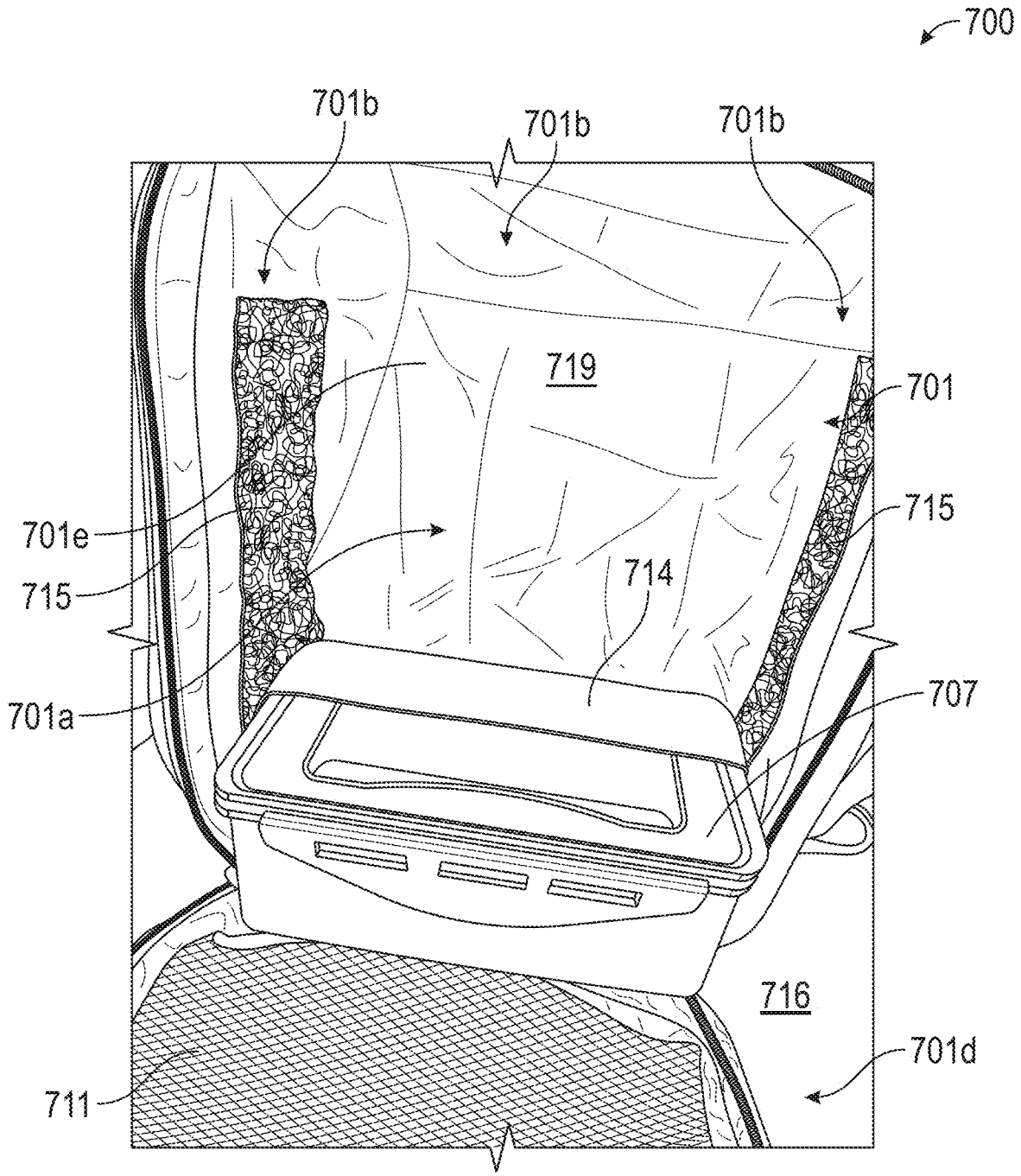
FIG. 7 illustrates the front view of the disclosed tactical meal management backpack holding a food storage container within the insulated pocket, according to an aspect.

FIG. 7 illustrates the front view of the disclosed tactical meal management backpack 700 holding a food storage container 707 within the insulated pocket 701, according to an aspect. The insulated pocket 701 may be provided with several features and structures to facilitate the secure handling of containers 707 holding food, drink, and other materials. One or more engagement surfaces, such as loop strips ("loop fastener strips") 715 may be secured within or otherwise associated with the insulated pocket 701 in order to provide the necessary mounting surface for a securing band 714 to be selectively attached to for restricting container 707 movement. A loop strip 715 may be secured to each applicable perimeter wall 701*b* of the insulated pocket, to allow for suitable positioning of a securing band 714. In an alternative embodiment, a singular, continuous engagement surface may be configured to attach to multiple applicable perimeter walls 701*b*. The securing band 714 may engage with the corresponding loop strips 715 at a selected height within the insulated pocket 701, such that the securing band 714 may secure an object, such as container 707, in place within the insulated pocket 701 to restrict its movement. This selected height of the securing band 714 may be selectively set by the user based upon the height of the container(s) to be stored within the insulated pocket 701.

A hook-loop fastener connector system, such as Velcro, may be utilized within the insulated pocket 701 to provide a mechanism for attaching each securing band 714 within the insulated pocket 701, as seen in FIG. 7. Loop strips 715 may have loop-based fasteners which are secured to or associated with each applicable perimeter wall 701*b* of the insulated pocket 701, such that a securing band 714 having compatible hook-based fasteners may be selectively engaged with each applicable loop strip 715. In an embodiment, this engagement between the securing band 714 and two loop strips 715 may be such that the securing band 714 extends between and engages with corresponding perimeter walls 701*b*. In doing so, the securing band 714 may be used to partition the insulated pocket 701, while surrounding and securing a container 707 in place, as shown in FIG. 7, thus securing said container 707 within the insulated pocket 701. In an alternative embodiment, each engagement surface may provide hook-based fasteners associated with the perimeter walls 701*b* that are configured to engage with loop-based fasteners disposed on the securing bands 714.

Figure 8:
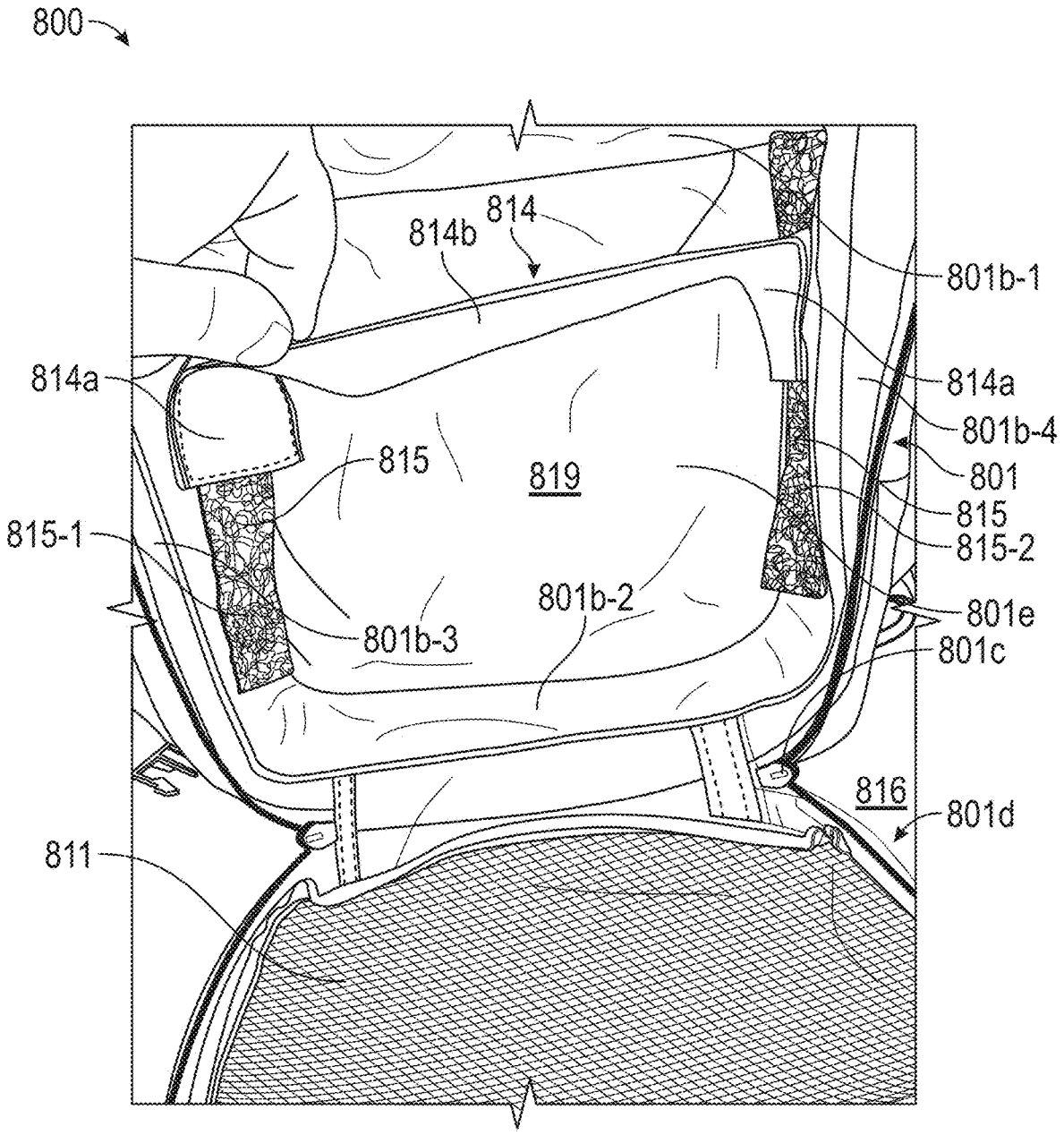
FIG. 8 illustrates the front view of the disclosed tactical meal management backpack having a securing band disposed within the insulated pocket, according to an aspect.

As seen in FIGS. 7-8, the perimeter walls 701*b*, 801*b*-1, 801*b*-2, 801*b*-3, 801*b*-4 may include each of the walls of the insulated pocket that engage directly with the inner wall 701*e*, 801*e* of the insulated pocket 701, 801. These perimeter walls 701*b* may also be engaged with or configured to selectively engage with an outer wall 701*d*, 801*d*, such that upon engagement of each perimeter wall with the outer wall 701*d*, 801*d*, an insulated cavity 719, 819 may be fully sealed from the external environment 716, 816. The perimeter walls 701*b* may include a top wall 801*b*-1, a bottom wall 801*b*-2, a left wall 801*b*-3 and a right wall 801*b*-4, as seen in FIG. 8. In certain alternative embodiments, an engagement surface may also be affixed to the inner wall 801*e*.

The insulated pocket 701 may have an insulated cavity 719 that is surrounded by an insulative layer 701*a* formed by the inner wall 701*e*, outer wall 701*d* and perimeter walls 701*b* while the insulated pocket 701 is sealed. This insulative layer 701*a* may be made from EPE cooler liner, and thus may be configured to allow the contents within the insulated pocket 701 to maintain their temperature for longer, as a result of being well insulated. The insulative layer 701*a* may slow the heat transfer between the inside of the insulated pocket 701 (e.g., the insulated cavity 719) and the external environment 716. For example, a cold food product stored within the insulated pocket 701 may be kept at a lower temperature for longer by sealing said cold food product within the insulated pocket 701, due to the presence of the surrounding insulative layer 701*a*. It should be understood that the external environment 716 may also include other pockets nested within the backpack body and any surrounding space(s) beyond the proximity of the insulative layer, such as the center pocket, as the insulative layer 701*a* is configured to surround the entirety of the insulated cavity 719 while sealed.

The temperature of the insulated pocket 701 may be further maintained by storing a temperature moderation device (not shown), such as a hot pack, cold pack, ice pack, etc., within the insulated pocket 701 alongside the containers 707. A mesh pocket 711 may be provided within the insulated pocket 701 to store said temperature moderation device, to help keep the insulated pocket 701 organized. This mesh pocket 711 may be attached to the outer wall 701*d* of the insulated pocket 701 to make accessing the temperature moderation device easier, as an item stored within the mesh pocket 711 may remain separated from items stored outside of the mesh pocket 711, without potentially being blocked by the contents of the insulated pocket 701. This may also allow the temperature moderation device to be accessed easily, allowing for its removal/replacement as needed, while not disturbing the secured containers 707.

FIG. 8 illustrates the front view of the disclosed tactical meal management backpack 800 having a securing band 814 disposed within the insulated pocket 801, according to an aspect. As disclosed hereinabove, the securing band 814 may have hook/loop-based fasteners configured to engage with each complementary engagement surface 815 (such as loop/hook strips, accordingly) within the insulated pocket 801. The positioning of this securing band 814 may be suitably adjusted by securing its engaging ends 814*a* to the appropriate portions of the corresponding loop strips 815, to achieve the necessary partition shape and volume to confine a held container. The securing band 814 may be placed at a lower elevation within the insulated pocket 801, as seen by securing band 714 of FIG. 7, in order to secure a shorter singular container in place. Alternatively, the securing band 714 may be placed at a higher elevation within the insulated pocket 801, as seen by securing band 814 of FIG. 8, in order to secure a taller singular container, or multiple stacked shorter containers in place. As such, it should be understood that the height/elevation within the securing pocket 801 that the securing band 814 is set to may correspond to the height of a container (or plurality of containers) that the securing band is configured to constrict, and this secure in place.

The hereinabove described configurations should be understood to be potential embodiments of the disclosed meal management backpack 800, as additional variations may also be implemented while remaining within the scope of the herein disclosed backpack 800. For example, additional securing bands 814, additional and/or alternatively positioned loop strips 815 (or other compatible types of engagement surfaces) and other features relevant to the secure handling of containers may also be implemented depending on the application of the backpack 800.

Each securing band 814 may have a securing band body portion 814*b* and two engaging ends 814*a* attached to opposing sides of the securing band body portion 814*b*, wherein each engaging end 814*a* is configured to engage directly with a corresponding loop strip 815 (or other compatible engagement surface). In an embodiment, the aforenoted hook type fasteners, or another fastener type that is configured to engage with the corresponding loop strip 815, may be disposed on said engaging ends 814*a* of the securing band 814, allowing the securing band 814 to be secured to the loop strips 815 on perimeter walls 801*b*-1, 801*b*-2, 801*b*-3, 801*b*-4 within the insulated pocket 801 to facilitate the secure holding of containers within the insulated pocket 801. As stated hereinabove, the perimeter walls may include the top wall 801*b*-1 and bottom wall 801*b*-2, as well as the left wall 801*b*-3 and the right wall 801*b*-4 disposed within the insulated pocket 801. These perimeter walls 801*b*-1, 801*b*-2, 801*b*-3, 801*b*-4 may be attached to an inner wall 801*e*, such that upon the engagement of the outer wall 801*d* with said perimeter walls, the insulated cavity 819 is sealed. While the provided figures may only depict the securing band 814 engaging with vertically oriented engagement surfaces 815 on left wall 801*b*-3 and the right wall 801*b*-4, thus resulting in a horizontally oriented securing band 814, it should be understood that the loop strips 815 may also be provided on the top wall 801*b*-1 and the bottom wall 801*b*-2 to facilitate a vertical orientation of the securing band 814 as needed. In an embodiment, each engaging end 814*a* of a securing band 814 may be attached to a singular, corresponding loop strip 815, as seen in FIG. 8, such that a container may be secured between the corresponding perimeter wall (s) and the securing band 814.

While each engagement surface, such as the loop strips 815, may be secured to a corresponding perimeter wall 801*b*-1, 801*b*-2, 801*b*-3, 801*b*-4 of the insulated pocket 801, the mesh pocket 811 may be secured directly to the outer wall 801*d* of the insulated pocket 801. In an embodiment, the mesh pocket 811 may be made of EPE. This outer wall 801*d* of the of the insulated pocket may be disposed between the mesh pocket 811 and the external environment 816. It should be understood that the outer wall 801*d* may be configured to be selectively engaged with applicable perimeter walls in order to seal the insulated pocket 801, such as through the utilization of an insulated pocket zipper 801*c* associated with the outer wall 801*d* and the applicable perimeter walls.

In an embodiment, the disclosed outer wall 801*d* of the insulated pocket 801 may be pivotally attached to or otherwise associated with the bottom wall 801*b*-2 of the insulated pocket 801, regardless of whether or not the insulated pocket 801 is sealed. In the same embodiment, the inner wall 801*e* may be attached to the top wall 801*b*-1, bottom wall 801*b*-2, left wall 801*b*-3 and right wall 801*b*-4. The engagement of the outer wall 801*d* with the bottom wall 801*b*-2 may be configured such that the outer wall 801*d* may be pivoted to suitably orient the outer wall 801*d* to allow for selective engagement of the outer wall 801*d* with the other three perimeter walls: the top wall 801*b*-1, left wall 801*b*-3 and right wall 801*b*-4. The disclosed insulated pocket zipper 801*c* may be configured to selectively adjoin or otherwise engage the outer wall 801*d* with these disclosed perimeter walls, thus selectively sealing the insulated cavity 819, as described hereinabove.

In an embodiment, the body portion 814*b* of securing band 814 disposed between the pair of engaging ends 814*a* may be made of an elastic material to allow for the securing band 814 to elastically conform around the shape of a container to hold the container in place within the insulated pocket 801. In an alternative embodiment, the body portion 814*b* of securing band 814 may be made of a rigid material. It should be understood that the materials used for the securing band 814, as well as any other materials used for the tactical management backpack 800 should be selected based on the desired application of said backpack (e.g., using higher durability materials for backpacks intended to withstand higher stresses and significant wear and tear). In an embodiment, the engaging ends 814*a* of each securing band may be comprised of a plurality of hook-based fasteners configured to engage with at least one corresponding engagement surface comprised of a plurality of loop based fasteners. In alternative embodiments, this hook-loop interaction may also be replaced with other suitable engagement structures, such as buttons, snaps, etc.

As can be seen in FIG. 8, a first engagement surface first loop strip 815-1 in the form of a first loop fastener strip ("first loop strip") may be attached to the left wall 801*b*-3 of the insulative layer 801 and second engagement surface 815-2 in the form of a second loop fastener strip ("second loop strip") may be attached to the right side wall 801*b*-4 of the insulative layer 801. The first and second engagement surfaces 815-1, 815-2 may be configured to engage with hook type fasteners disposed on each engagement end 814*a* of the securing band 814. In an embodiment, the hook type fasteners of the securing band 814 and loop type fasteners of the loop strips 815-1, 815-2 may be Velcro style hook/loop fasteners to facilitate easy installation/removal of the securing band 814 from the insulated pocket 801, while still allowing the securing band 814 to securely restrain a container(s) while engaged with the corresponding engagement surfaces 815-1, 815-2.

It should be noted that in the embodiment of FIG. 8, the first loop fastener strip 815-1 and second loop fastener strip 815-2 may both be vertically oriented such that they roughly span the height of their corresponding attached side walls 801*b*-3, 801*b*-4. The term "vertically oriented" in the context of loop fastener strips/engagement surfaces 815-1, 815-2 should be understood to indicate that said object having a vertical orientation has a height that is greater than its length or width, as seen by the vertically oriented loop faster strips 815-1, 815-2 of FIG. 8. Such a placement and orientation of the loop fasteners strips (or other engagement surfaces) may allow a user to easily provide a horizontal barrier within the insulated pocket that spans between the corresponding side walls 801*b*-3, 801*b*-4. As such the securing band 814 (and thus the securing band body portion 814*b*) may be horizontally oriented and disposed between and perpendicular to the first loop fastener strip 815-1 and second loop fastener strip 815-2. As described herein, a user may selectively set the height/position of the securing band 814 based on the height of the container(s) to be stored within the insulated pocket 801, such that the securing band 814 may be configured to securely hold a stored container within the insulated pocket 801 in place regardless of container height/quantity.

In an alternative embodiment of the disclosed insulated pocket 801, modifications may be made to accommodate different use scenarios. For example, a third loop fastener strip and a fourth loop fastener strip may be placed on the top wall 801*b*-1 and the bottom wall 810*b*-2, respectively. In such an embodiment, the third and fourth loop fastener strips may be horizontally oriented, and a securing band configured to engage with said third and fourth loop fastener strips may be vertically oriented. Such a configuration may be useful when carrying taller, narrower containers within the insulated pocket 801. In another alternative embodiment, an additional loop fastener strip may be positioned on the inner wall 801*e* of the insulated pocket to provide and additional engagement location for engaging alternatively configured engagement bands having additional engaging ends.

Figure 9:
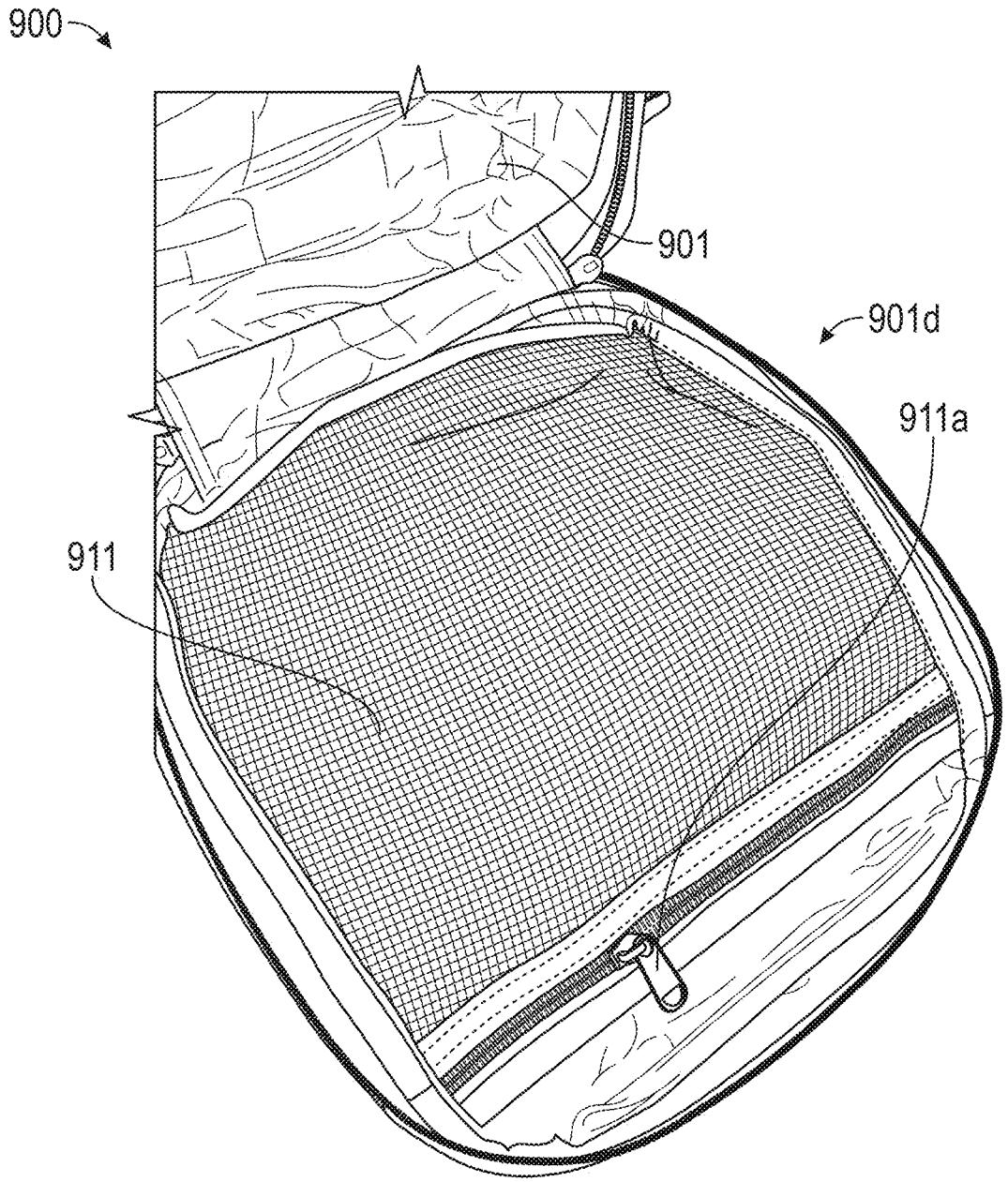
FIG. 9 illustrates the top view of the mesh pocket of the disclosed tactical meal management backpack, according to an aspect.

FIG. 9 illustrates the top view of the mesh pocket 911 of the disclosed tactical meal management backpack 900, according to an aspect. As disclosed hereinabove, the mesh pocket 911 may be attached to the outer wall 901*d* and be utilized to store a temperature moderation device (not shown), to help maintain the temperature of food, drinks, etc. stored within the insulated pocket 901. The mesh pocket 911 may include a mesh pocket zipper 911*a* configured to allow the mesh pocket 911 to be selectively opened and closed, thus preventing a stored temperature moderation device from falling out of the mesh pocket 911 while stored within. The mesh pocket 911 may also be utilized for additional storage, if a temperature moderation device is not needed, or if additional room within the mesh pocket 911 is available.

As disclosed hereinabove, the temperature moderation device may be stored within the mesh pocket 911 in order to keep sad temperature moderation device physically separated from the other contents of the insulated pocket 901, while still allowing said temperature moderation device to moderate the temperature of the insulated pocket 901. In an embodiment, the disclosed temperature moderation device may be a hot pack, wherein the temperature moderation device is configured to maintain the contents of the insulated pocket 901 at a higher temperature, such as 140° F. or above, for an extended duration of time. In an alternative embodiment, the disclosed temperature moderation device may be an ice pack or cold pack, wherein the temperature moderation device is configured to maintain the contents of the insulated pocket 901 at a lower temperature, such as 40° F. or below, for an extended duration of time. The insulative layer, such as insulative layer 701*a* of FIG. 7, may also provide a moisture impermeable barrier between the inside and outside of the insulated pocket 901, such that a desiccant packet or comparable humidity control element may be used in place of, as part of, or in conjunction with the temperature moderation device to moderate the humidity of the insulated pocket, for applications in which moderation of such conditions are relevant. In an embodiment, the insulative layer 701*a* may be made of EPE, as disclosed hereinabove. In alternative embodiments, alternative insulative materials may be utilized in the construction of the insulative layer, and thus the insulated pocket 901, as long as said insulative layer is suitably configured to help maintain the desired temperature conditions within said insulated pocket 901.

Figure 10:
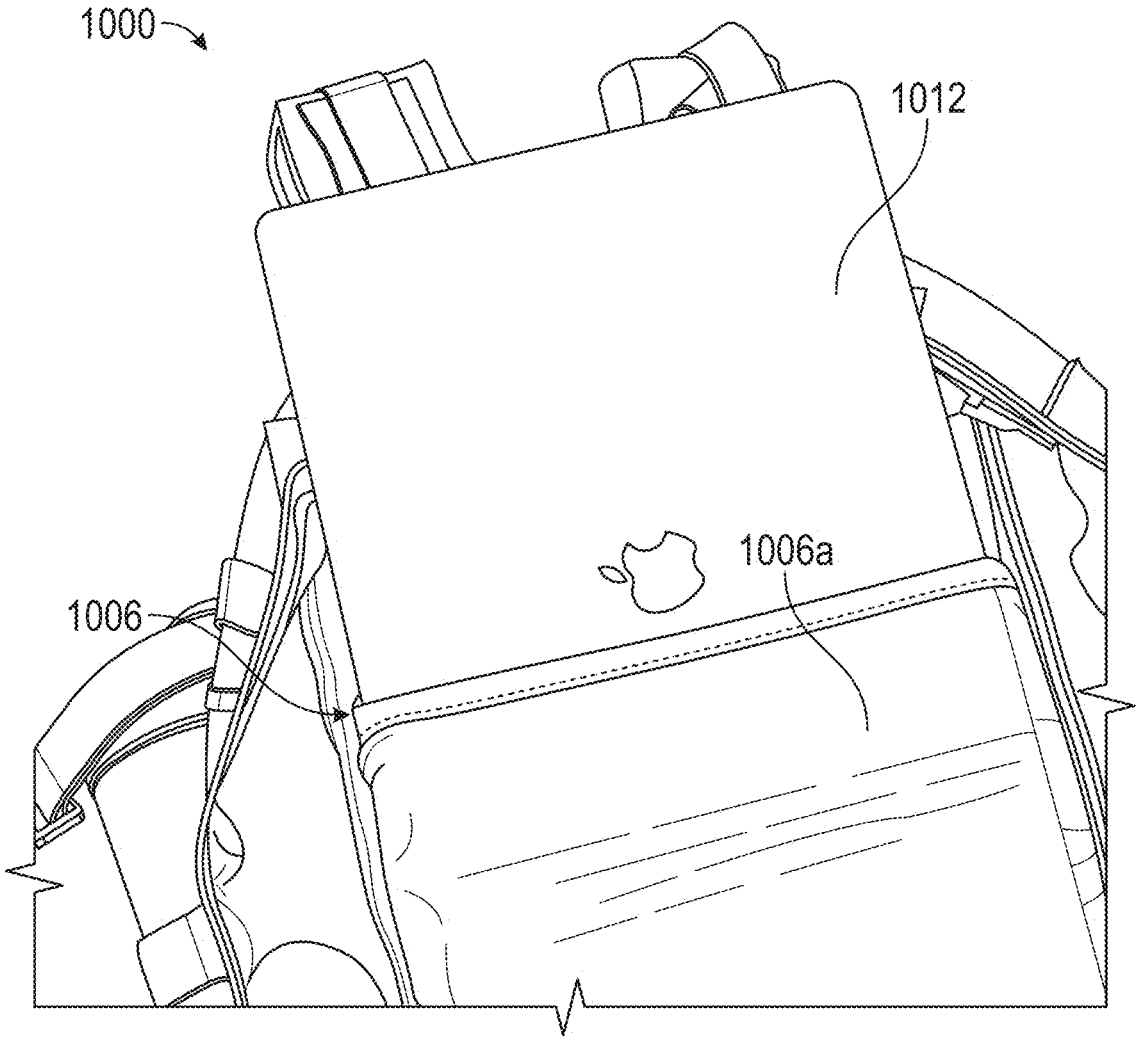
FIG. 10 illustrates the front perspective view of the open back pocket of the disclosed tactical meal management backpack, according to an aspect.

FIG. 10 illustrates the front perspective view of the open back pocket 1006 of the disclosed tactical meal management backpack 1000, according to an aspect. It should be understood that the disclosed tactical meal management backpack 1000 may be used for the storage of food and/or non-food materials. In an embodiment, the disclosed tactical management backpack 1000 may be utilized to transport non-food items, such as medical samples, that require temperature moderation. It should also be understood that food and non-food items may be stored within the backpack 1000 simultaneously, potentially even within the same pocket. In an embodiment, the back pocket 1006 may be used to store non-food items, including electronics, such as laptops 1012, cell phones, etc. This back pocket 1006 may include a back pocket sleeve 1006*a* nested within or otherwise associated with the back pocket 1006, wherein said back pocket sleeve 1006*a* may be configured to securely hold a laptop 1012 or another object within the back pocket 1006 to prevent the laptop 1012/other object from shifting or moving within the back pocket 1006. Other electronic holding sleeves and compartments may also be provided, such as cell phone compartments (not shown) to allow for safe storage and easy access to each stored object.

The positioning of electronics and other objects in the back pocket 1006 may help to distance them from the temperature maintained within the insulated pocket, which may be relevant for certain stored objects. For example, if the insulated pocket is kept at a higher temperature, it may be desirable to avoid putting electronics in direct contact with or in close proximity to the insulated pocket. By storing electronics in the back pocket 1006, and temperature moderated items, such as foods, within the insulated pocket, the center pocket may be used as a buffer between the temperature moderated items of the insulated pocket and the items stored within the back pocket 1006.

Figure 11:
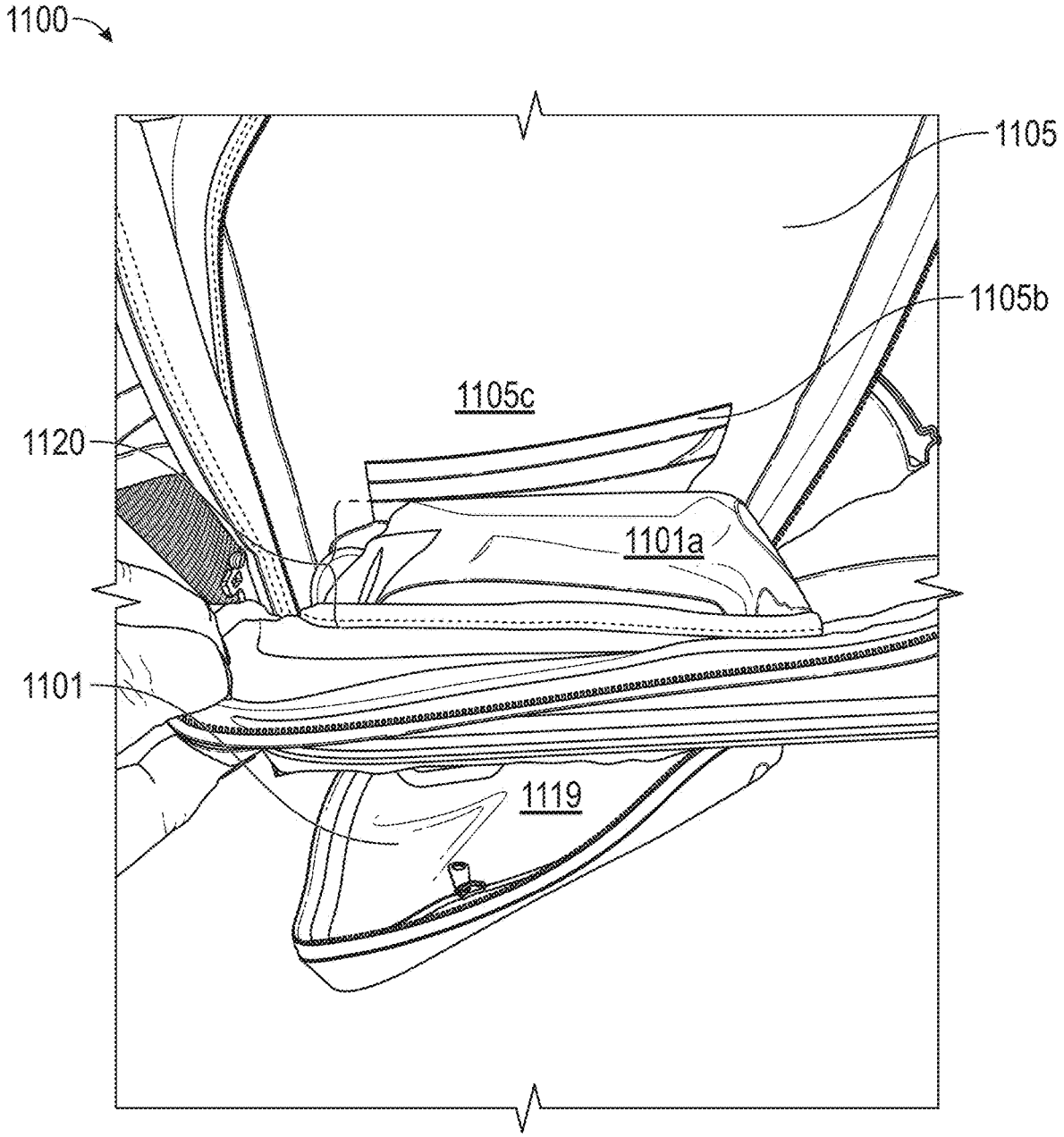
FIG. 11 illustrates the top perspective view of the open center pocket and the open insulated pocket of the disclosed tactical meal management backpack, according to an aspect.

FIG. 11 illustrates the top perspective view of the open center pocket 1105 and open insulated pocket 1101 of the disclosed tactical meal management backpack 1100, according to an aspect. As disclosed hereinabove, the insulated pocket 1101 may be configured such that it may selectively extend or protrude into a portion of the volume normally occupied by the center pocket 1105, while still being insulated and remaining separated from the center pocket 1105. Thus, the insulated pocket 1101 may protrude into the center pocket 1105, as seen by the protrusion 1120 of the insulated pocket 1101 within the center pocket 1105. In an embodiment, the inner wall, such as inner wall 801*e* of FIG. 8, of the insulative layer 1101*a* may protrude into the center pocket 1105 or another suitable portion of the backpack to allow for expansion of the insulated pocket 1101. The protrusion 1120 of the insulated pocket 1101 into the center pocket 1105 may effectively increase the volume of the insulated pocket 1101 and reduce the volume of the center pocket 1105. This may happen as a result of the total volume occupied by the center pocket and the insulated pocket together being constant.

In an embodiment, the insulated pocket 1101 may have an insulated cavity 1119 having a first volume, whereas the center pocket 1105 may have a center cavity 1105*c* having a second volume. By allowing the insulated pocket 1101 to selectively protrude into the center pocket 1105, as seen in FIG. 11, the first volume may be increased and the second volume may be decreased, thus increasing the volume of the insulated cavity 1119 and decreasing the volume of the center cavity 1105*c* while keeping the sum of the two volumes consistent. In other words, the insulative layer 1101*a* of the insulated pocket 1101, may be configured expand, extend or protrude into the center pocket 1105 to provide more space within the insulated pocket 1101, thus increasing the space available within the insulated pocket for temperature-controlled storage. This functionality may be useful in numerous applications, as it allows the overall volume of the backpack 1100 to be maintained, even when carrying greater volumes of materials in the insulated pocket 1101, thus preventing the backpack 1100 from becoming overly bulk.

The non-insulative (or less insulative) materials used for the backpack body may include canvas, nylon, plastic and other suitably durable backpack materials, whereas each zipper may be made of steel, aluminum, plastic and or another suitably durable material. The insulative layer 1101 may be made of a suitably effective insulative material, such as the prior disclosed EPE material, or another sufficiently flexible insulative material. A center pocket sleeve 1105*b* may be nested within the center pocket 1105 in order to allow for the secure storage of objects within the center pocket, while preventing said objects from travelling freely within the center pocket 1105.

Figure 12:
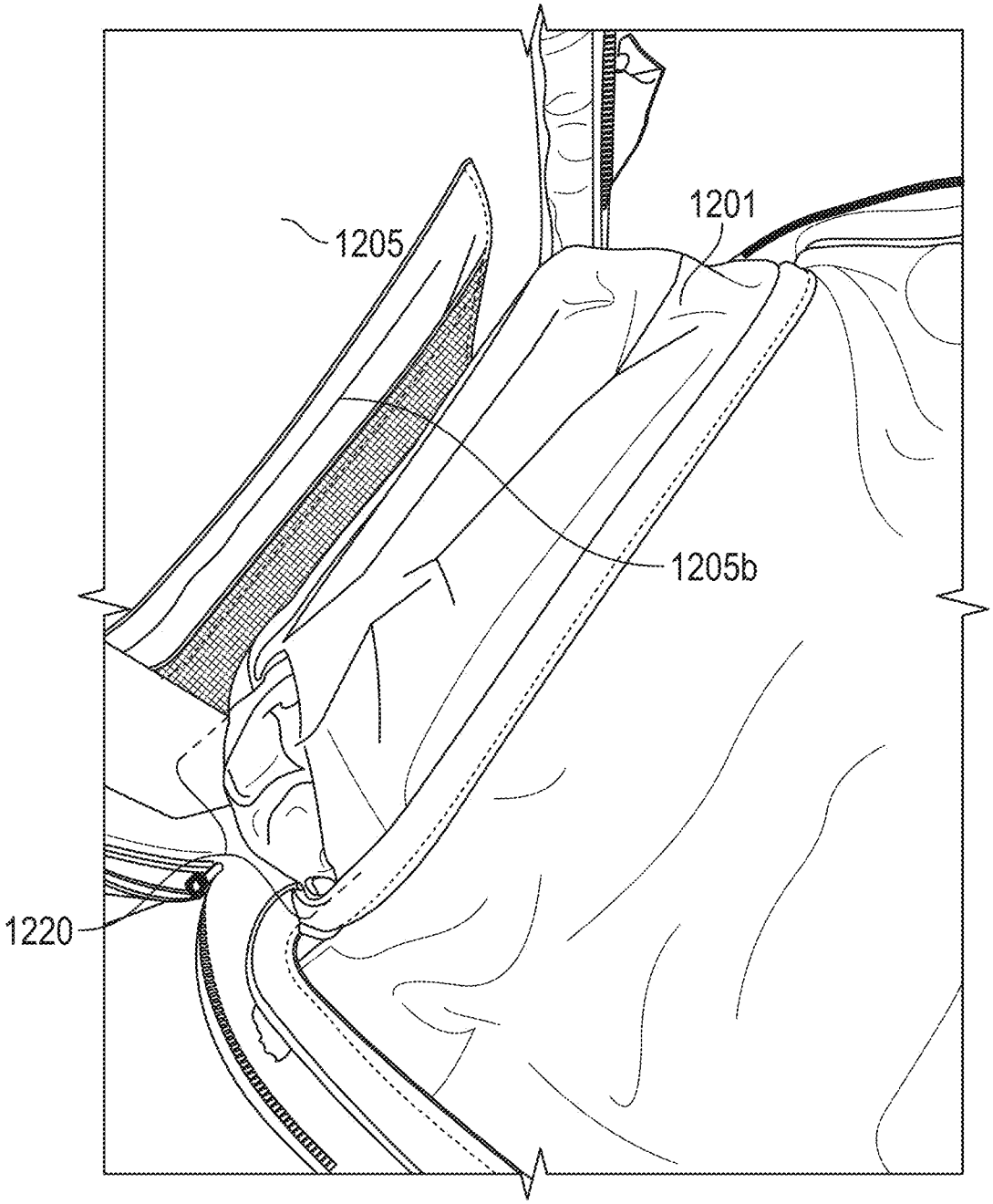
FIG. 12 illustrates the top perspective view of the inside of the center pocket, according to an aspect.

FIG. 12 illustrates the top perspective view of the inside of the center pocket 1205, according to an aspect. As can be seen in FIG. 12, the insulated pocket 1201 may protrude into the center pocket 1205 to allow for larger containers to be stored within the insulated pocket 1201 without significantly increasing the overall depth of the meal management backpack. This protrusion 1220 may be selectively utilized based upon the desired size of the insulated pocket 1201, whereas the protrusion 1220 may be configured to not extend into the volume of the center pocket 1205 while the volume of objects within the insulated pocket is small enough to avoid this. Again, the center pocket sleeve 1205*b* may be used to securely store objects within the center pocket 1205 while restricting their movement to a smaller area within the center pocket 1205.

Figure 13:
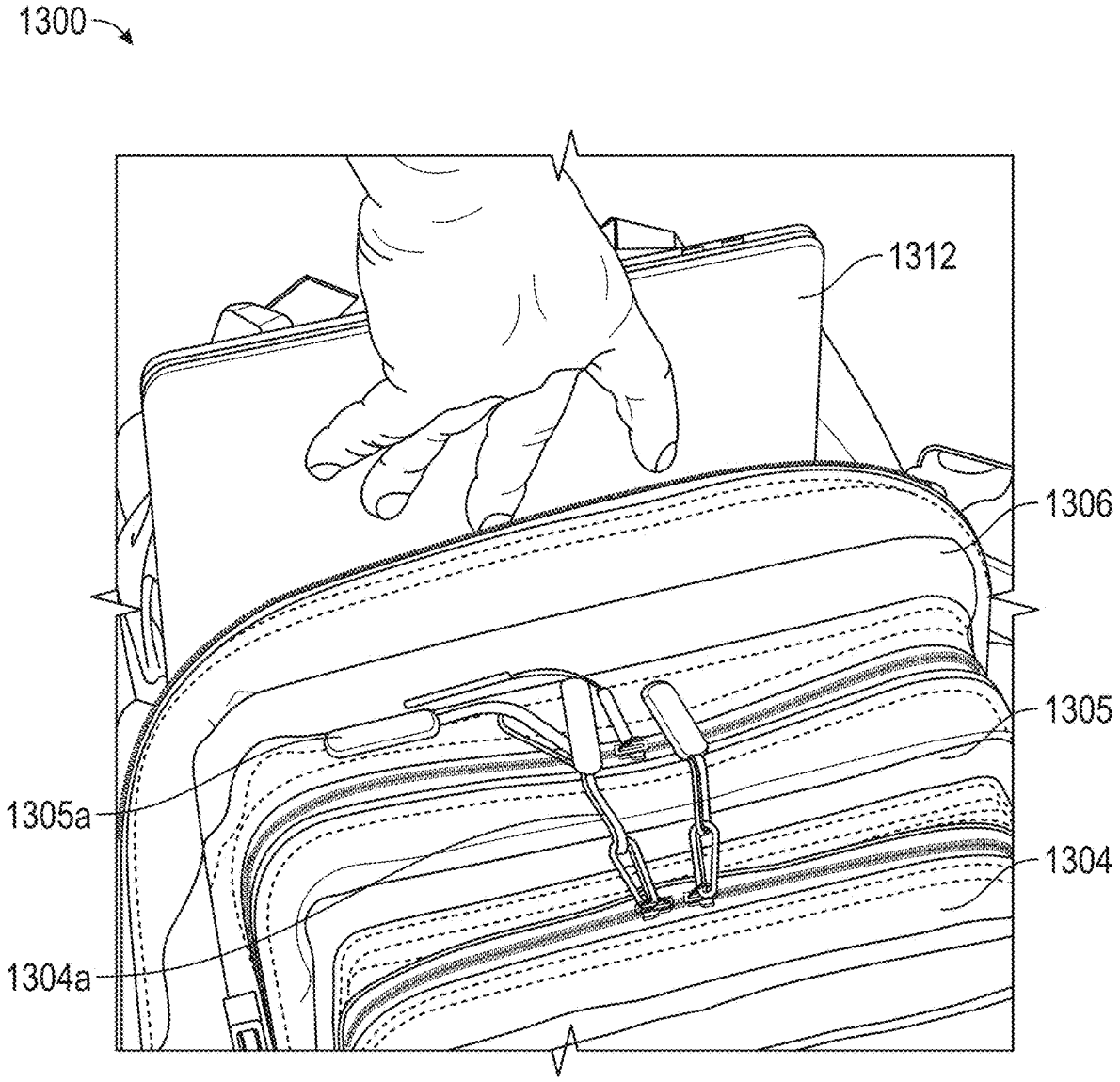
FIG. 13 illustrates the front perspective view of a laptop being stored within the open back pocket of the disclosed tactical meal management backpack, according to an aspect.

FIG. 13 illustrates the front perspective view of a laptop 1312 being stored within the open back pocket 1306 of the disclosed tactical meal management backpack 1300, according to an aspect. The disclosed meal management backpack 1300 may utilize a plurality of pockets, as described hereinabove, to store a variety of different materials, while allowing the materials to be easily transported by simply carrying or wearing the backpack 1300. An insulated pocket, such as insulated pocket 101 of FIG. 1, may have an insulative layer, such as insulative layer 701*a* of FIG. 7, that is configured to allow materials held within the insulated pocket to be maintained at a desired temperature for extended periods of time. A front pocket 1304 and a center pocket 1305 may be positioned adjacently to the insulated pocket, wherein said front pocket 1304 center pocket 1305 may also be configured to securely hold materials, such as food, but without facilitating superior maintenance of their temperature. The back pocket 1306 may be sufficiently distant from the insulated pocket, as to not be influenced or impacted significantly by its insulated cavity temperature, and thus may be well suited for the storage of electronics, such as laptops 1312.

As described previously, each pocket may have a corresponding zipper to allow for its selective opening to expose a corresponding pocket cavity to the external environment, wherein the front pocket 1304 has a front pocket zipper 1304*a*, the center pocket 1305 has a center pocket zipper 1305*a*. The insulated pocket may also have one or more insulated pocket zippers, such as insulated pocket zippers

101*c* of FIG. 1, while the back pocket may have a back pocket zipper, such as back pocket zipper 106*b* of FIG. 1. The combination of the features of the tactical management backpack 1300 disclosed herein provides an overall meal management solution capable of providing easy access storage of drinks though the utilization of side pockets, such as side pockets 102-1, 102-2 of FIG. 1, and an insulated storage pocket capable of preserving food at a desired temperature for later consumptions, while simultaneously allowing for the storage of additional materials separately from the disclosed insulated storage compartments, all in a convenient and portable storage case.

Figure 14A:
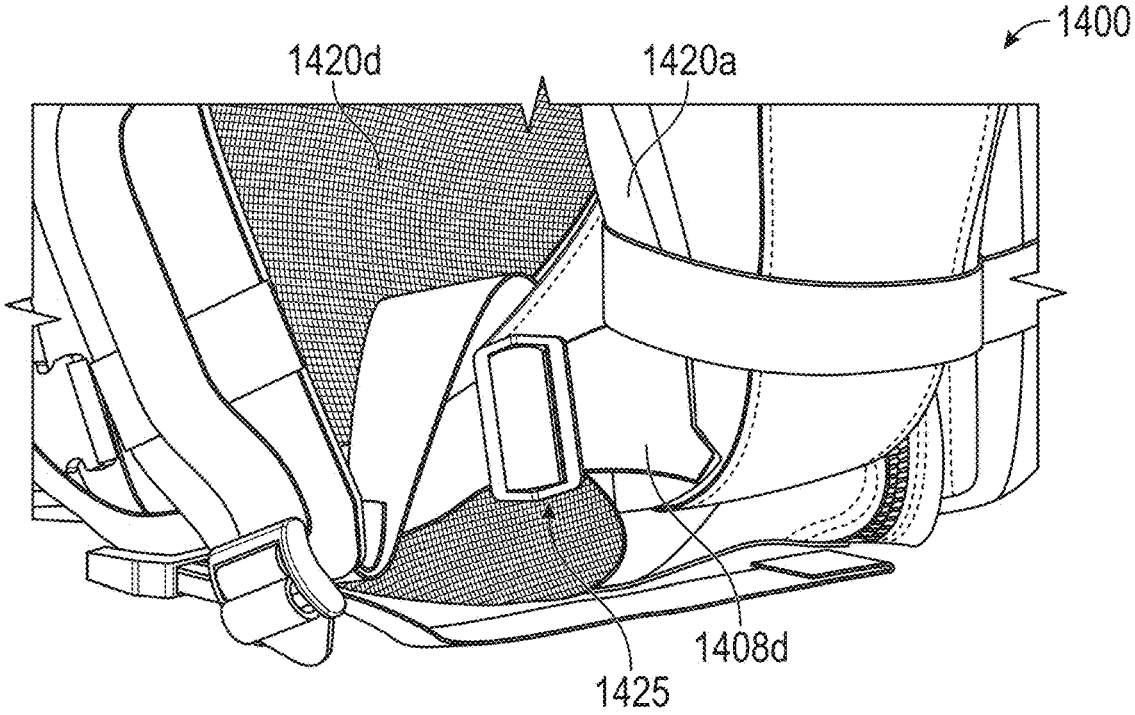
FIG. 14A illustrates the side view of a meal management backpack having a guide clamp, according to an aspect.
Figure 14B:
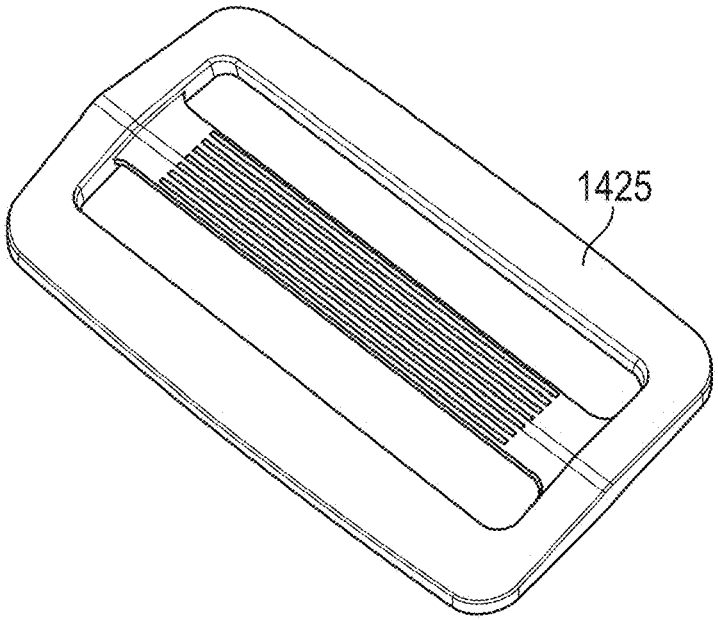
FIG. 14B illustrates the top perspective view of a guide clamp, according to an aspect.

FIG. 14A illustrates the side view of a meal management backpack 1400 having a securing clamp 1425, according to an aspect. FIG. 14B illustrates the top perspective view of a securing clamp 1425, according to an aspect. In order to suitably secure the left and right segments of the back belt, such as back belt 608-3, to the backpack body, a pair of securing clamps 1425 may be implemented. In an embodiment, a left side securing clamp 1425 may be secured to the back side 1420*d* of the backpack body, such that said left side securing clamp is adjacent to the left lateral side 1420*a* of the backpack body. The same may also be done for a right side securing clamp (not shown) which may be attached to the back side 1420 of the backpack body and adjacently disposed to the right lateral side of the backpack body (not shown). As disclosed hereinabove, each securing clamp 1425 may be configured to engage with a corresponding segment of the back belt, such that a left segment 1408*d* of the back belt is secured to the left side securing clamp 1425, while a right side segment of the back belt, such as right segment 608*e* of back belt 608-3 in FIG. 6, is secured to the right side securing clamp. It should be understood that the mechanism used to attach each belt to the backpack body, the user and themselves, as applicable, may be varied, as long as the intended capability of each belt is maintained.

Figure 15A:
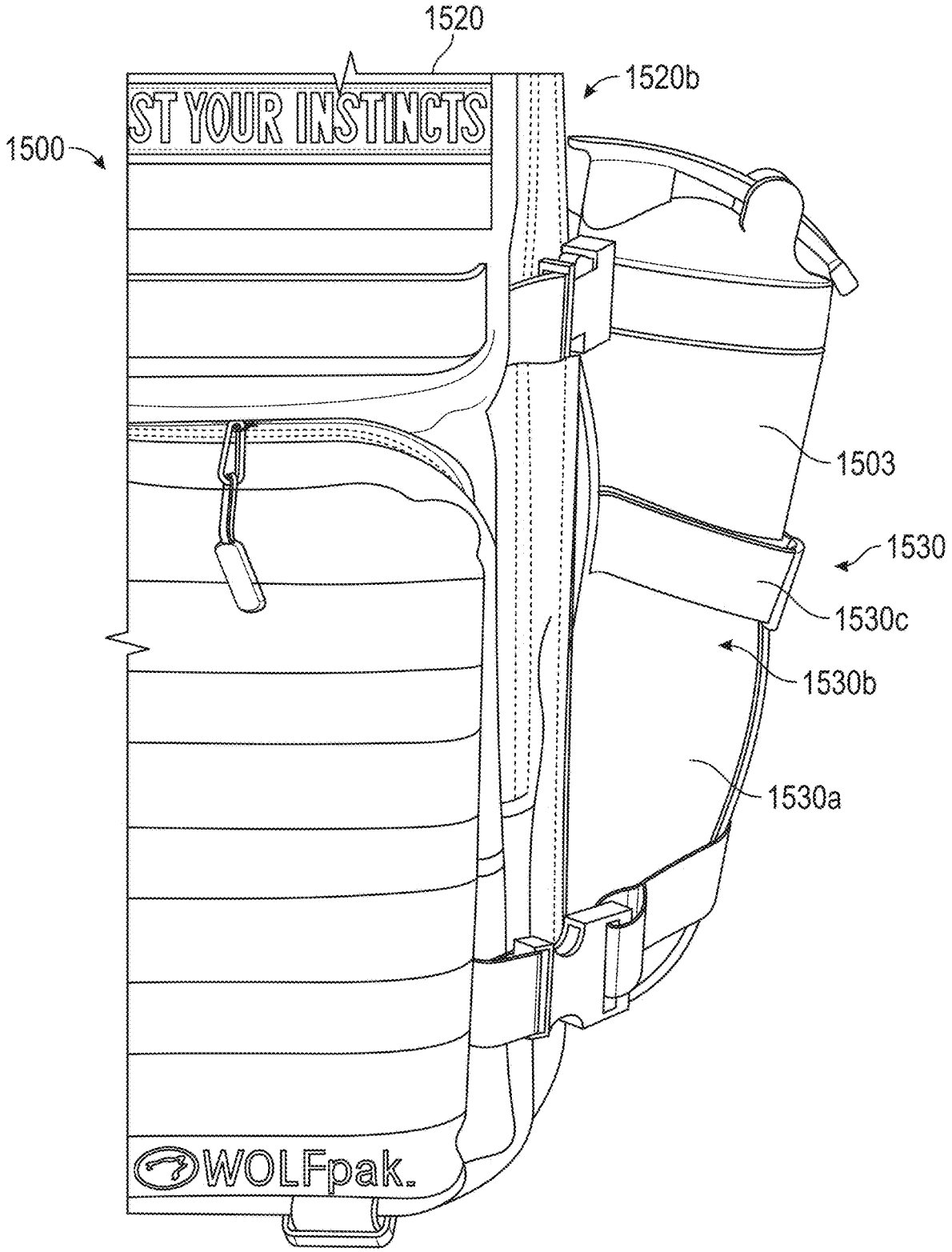
FIG. 15A-15B illustrate the front and left side views, respectively, of a meal management backpack having an alternative side pocket embodiment, according to an aspect.
Figure 15B:
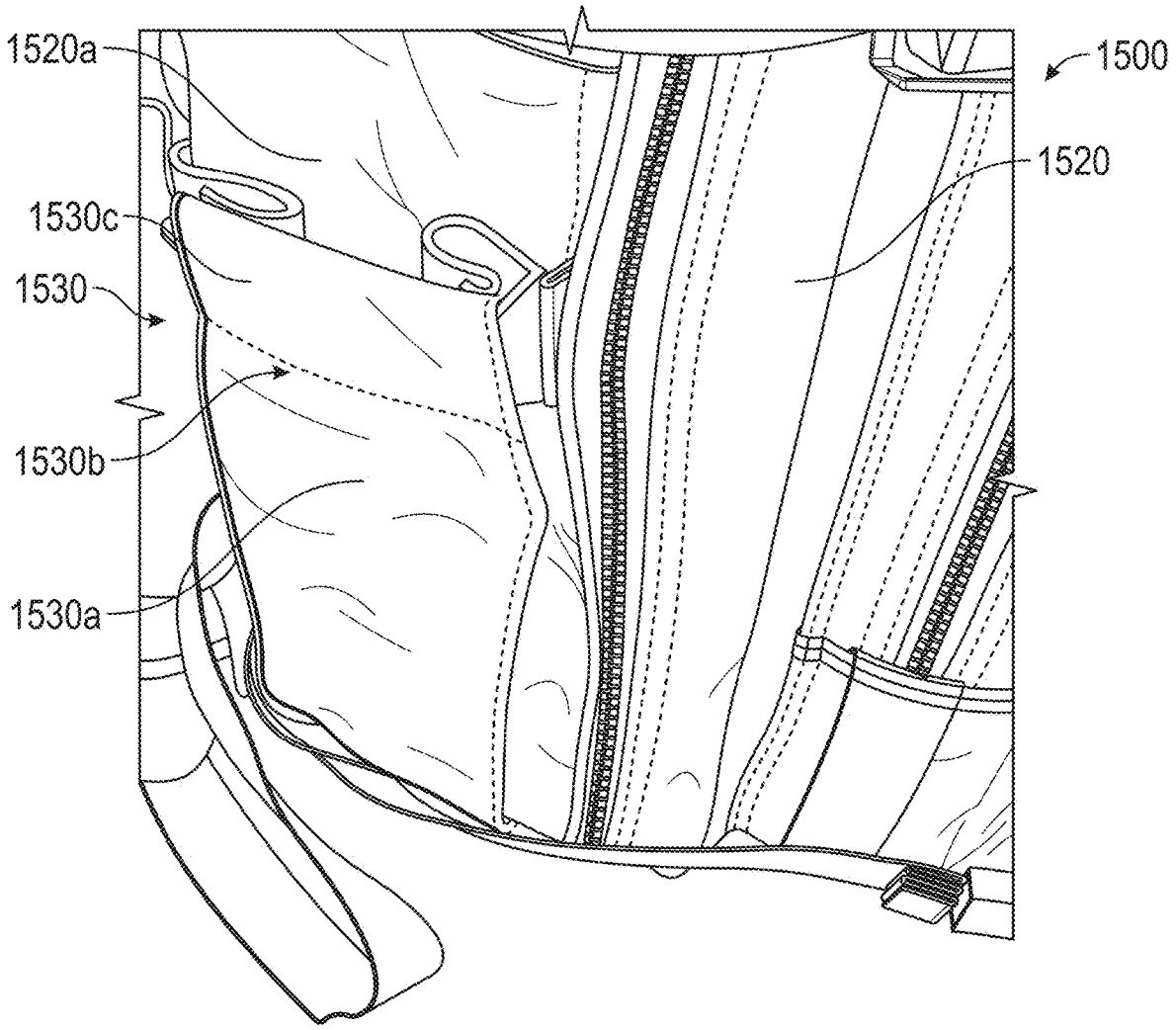

FIG. 15A-15B illustrate the front and left side views, respectively, of a meal management backpack 1500 having an alternative side pocket 1530, according to an aspect. Depending on the application for a specific meal management backpack 1500, it may be desirable to utilize an alternative structure for each of the side pockets. In an embodiment, one such alternative side pocket may be a collapsible side pocket 1530. The collapsible side pocket may be comprised of a collapsible receptacle slot 1530*a* having a top portion 1530*b*, the collapsible receptacle slot 1530*a* being attached to a corresponding lateral side 1520*a*, 1520*b* of the backpack body 1520, and a compression band 1530*c* secured to a top portion 1530*b* of the receptacle slot 1530*a*. The compression band 1530*c* may be engaged with the top portion 1530*b* of the receptacle slot 1530*a*, such that it is configured to apply tension to the collapsible receptacle slot 1530*a*, thus collapsing said collapsible side wall 1530*a* against the corresponding lateral side 1520*a*, 1520*b* of the backpack body 1520 while the collapsible side pocket is empty, as seen in FIG. 15B. While a receptacle 1503 is nested within the collapsible side pocket 1530, as seen in FIG. 15A, the compression band 1530*c* may apply tension to the top portion 1530*b* of the collapsible receptable slot 1530*a*, thus securing the receptacle 1503 within the collapsible side pocket 1530, until the user elects to remove it.

As can be seen in FIGS. 15A-15B, the collapsible receptacle slot 1530*a* of the collapsible side pocket 1530 may differ from the receptacle slot of the prior disclosed side pocket, such as side pocket 102 of FIG. 1. The receptacle slot 102*c* of the side pocket 102 of FIG. 1, may be comprised of a mesh material, whereas the collapsible receptacle slot 1530*a* of the collapsible side pocket 1530 may be comprised of a solid material, that may be commensurate to the solid material used for the attached backpack body. One advantage of utilizing a solid material for the collapsible receptacle slot 1530*a* of the collapsible side pocket 1530, rather than a mesh material, is that the solid material of the collapsible receptacle slot 1530*a* may provide greater protection to the portion of the receptacle 1503 concealed within the collapsible side pocket 1530, as a result of not allowing materials, such as liquids or small solids, to travel through said collapsible side wall as easily. Another advantage is that the collapsible side pocket 1530 may be configured to automatically collapse in on itself while not in use, and automatically expand out when a receptacle 1503 is forced within it, thus allowing the collapsible side pocket 1530 to selectively hold a receptacle without requiring manual adjustment of a tension cord or other additional element.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A tactical management backpack comprising:
a backpack body;
an insulated pocket nested within the backpack body, the insulated pocket having:
an insulative layer surrounding an insulated cavity, the insulative layer having:
a top wall;
a bottom wall;
a left wall;
a right wall;
an inner wall; and
an outer wall;
wherein the inner wall is attached to the top wall, bottom wall, left wall and right wall, and the outer wall is pivotally attached to the bottom wall and configured to selectively engage with the top wall, left wall and right wall to seal the insulated cavity, wherein the insulative layer is configured to slow heat transfer between the insulated cavity and an external environment;
at least one engagement surface attached to the insulative layer;
a securing band configured to selectively engage with the engagement surface at a selected height, such that the securing band is configured to secure an object within the insulated pocket;
a pair of lower side belts, each lower side belt comprising:
a front segment attached to the insulated pocket;
a back segment attached to a back side of the backpack body; and
a joining buckle configured to selectively secure the corresponding front segment to the corresponding back segment;
a first side pocket associated with a left lateral side of the backpack body and a second side pocket associated with a right lateral side of the backpack body, wherein the first and second side pockets are each configured to selectively engage with a corresponding receptacle to secure the corresponding receptacle to the backpack body;
wherein the inner wall of the insulative layer is configured to selectively protrude into a center pocket nested within the backpack body, such that a volume of the insulated cavity of the insulated pocket may be selectively increased.

2. The tactical management backpack of claim 1, further comprising a pair of backpack straps attached to the back side of the backpack body.

3. The tactical management backpack of claim 1, each side pocket comprising:
a receptacle slot configured to seat the receptacle;
a tension cord housing associated with and disposed above the receptacle slot, the tension cord housing being configured to surround an upper portion of the receptacle; and
a tension cord nested within the tension cord housing, wherein the tension cord is configured to selectively constrict the tension cord housing around the upper portion of the receptacle to secure the receptacle within the corresponding side pocket.

4. The tactical management backpack of claim 1, each side pocket comprising:
a collapsible receptacle slot having a top portion; and
a compression band configured to engage with the top portion of the collapsible receptacle slot, such that compression band is configured to collapse the collapsible receptacle slot while the corresponding side pocket is not holding a receptacle.

5. The tactical management backpack of claim 1, wherein the securing band selectively engages with the engagement surface through the usage of hook and loop fasteners.

6. The tactical management backpack of claim 1, wherein each engagement surface is vertically oriented.

7. The tactical management backpack of claim 1, wherein the securing band is comprised of a securing band body portion and two engaging ends, wherein the securing band body portion is disposed between and associated with the two engaging ends, and each engaging end is configured to engage directly with a corresponding engagement surface.

8. The tactical management backpack of claim 1, wherein the insulative layer is made of expanded polyethylene.

9. The tactical management backpack of claim 1, further comprising an insulated pocket zipper engaged with the outer wall, wherein the insulated pocket zipper is configured facilitate the selective engagement of the outer wall with the top wall, left wall and right wall to seal the insulated cavity.

10. A tactical management backpack comprising:
a backpack body;
an insulated pocket nested within the backpack body, the insulated pocket having:
an insulative layer surrounding an insulated cavity, wherein the insulative layer is configured to selectively seal the insulated cavity and slow heat transfer between the insulated cavity and an external environment;
a first and second vertically oriented loop fastener strips attached to the insulative layer; and
a securing band having two engaging ends and a securing band body portion disposed between and associated with the two engaging ends, each engaging end having hook fasteners, wherein the engaging ends of the securing band are configured to engage with the first vertically oriented loop fastener strip and the second vertically oriented loop fastener strip at a selected height corresponding to a height of an object to be secured within the insulated pocket, such that the securing band is horizontally oriented;

a front pocket nested within a front side of the backpack body and disposed above the insulated pocket;

a back pocket nested within a back side of the backpack body; and a center pocket nested within the backpack body between the back pocket and the insulated pocket.

11. The tactical management backpack of claim 10, further comprising a pair of backpack straps secured to a back side of the backpack body.

12. The tactical management backpack of claim 10, wherein the insulated pocket is nested within a front side of the backpack body.

13. The tactical management backpack of claim 10, wherein the insulative layer is configured to selectively protrude into the center pocket nested within backpack body, such that a volume of the insulated cavity may be selectively increased.

14. A tactical management backpack comprising:

an insulated pocket having:

an insulative layer surrounding an insulated cavity, the insulative layer having:

a top wall;

a bottom wall;

a left wall;

a right wall;

an inner wall; and an outer wall;

wherein the inner wall is attached to the top wall, bottom wall, left wall and right wall, and the outer wall is attached to the bottom wall and configured to selectively engage with the top wall, left wall and right wall to seal the insulated cavity, wherein the insulative layer is configured to slow heat transfer between the insulated cavity and an external environment;

a first loop fastener strip attached to the left wall;

a second loop fastener strip attached to the right wall; and a securing band having two engaging ends and a securing band body portion disposed between and associated with the two engaging ends, each engaging end having hook fasteners, wherein the engaging ends of the securing band are configured to engage with the first loop fastener strip and the second loop fastener strip at a selected height corresponding to a height of an object to be secured within the insulated pocket, such that the securing band is disposed between the first loop fastener strip and the second loop fastener strip;

wherein the insulative layer is configured to selectively protrude into a center pocket nested within the tactical management backpack, such that a volume of the insulated cavity may be selectively increased without increasing the overall volume of the tactical management backpack.

15. The tactical management backpack of claim 14, wherein the first loop fastener strip and the second loop fastener strip are vertically oriented, such that the securing band body portion is configured to be horizontally oriented disposed between the first and second loop fastener strips.

* * * * *